US005790157A

United States Patent [19]

Higuma et al.

[11] Patent Number: 5,790,157

[45] Date of Patent: Aug. 4, 1998

[54] INK FILLING METHOD AND APPARATUS FOR INK CARTRIDGE

[75] Inventors: Masahiko Higuma, Tohgane; Masami Ikeda, Yokohama; Sadayuki Sugama, Tsukuba; Tsutomu Abe, Isehara; Hiroyuki Ishinaga, Tokyo; Toshio Kashino, Chigasaki; Takeshi Okazaki, Sagamihara; Hiroki Tajima, Kawasaki, all of Japan

[73] Assignee: Canon Kabushiki Kaisha, Tokyo, Japan

[21] Appl. No.: 297,817

[22] Filed: Aug. 30, 1994

[30] Foreign Application Priority Data

| | | | |
|---|---|---|---|
| Aug. 31, 1993 | [JP] | Japan | 5-216551 |
| Sep. 2, 1993 | [JP] | Japan | 5-218636 |
| Sep. 8, 1993 | [JP] | Japan | 5-223488 |
| Sep. 30, 1993 | [JP] | Japan | 5-244662 |

[51] Int. Cl.[6] ..... B41J 2/175

[52] U.S. Cl. ..... 347/85

[58] Field of Search ..... 347/86, 87, 85

[56] References Cited

U.S. PATENT DOCUMENTS

| | | | |
|---|---|---|---|
| 4,145,967 | 3/1979 | Marozzi | 101/333 |
| 4,771,295 | 9/1988 | Baker et al. | 347/87 |
| 4,794,409 | 12/1988 | Cowger et al. | 347/7 |
| 4,967,207 | 10/1990 | Ruder | 347/7 |
| 4,968,998 | 11/1990 | Allen | 347/87 |
| 5,025,271 | 6/1991 | Baker et al. | 347/87 |
| 5,113,205 | 5/1992 | Sato et al. | 347/85 |
| 5,329,294 | 7/1994 | Ontawar et al. | 347/87 |
| 5,453,771 | 9/1995 | Waseda et al. | 347/86 |
| 5,509,140 | 4/1996 | Koitabashi et al. | 347/86 |
| 5,619,238 | 4/1997 | Higuma et al. | 347/86 |

FOREIGN PATENT DOCUMENTS

| | | | |
|---|---|---|---|
| 0261764 | 3/1988 | European Pat. Off. | B41J 27/18 |
| 0581531 | 2/1994 | European Pat. Off. | B41J 2/175 |
| 14963 | 1/1986 | Japan | 347/86 |
| 63-087242 | 4/1988 | Japan . | |
| 02000522 | 1/1990 | Japan . | |
| 2198864 | 8/1990 | Japan | B41J 2/175 |
| 156339 | 5/1992 | Japan | 347/87 |
| 96743 | 4/1993 | Japan | 347/86 |
| 131642 | 5/1993 | Japan | 347/87 |
| 162332 | 6/1993 | Japan | 347/86 |
| 06040043 | 2/1994 | Japan . | |
| 2268910 | 1/1994 | United Kingdom . | |
| 2268911 | 1/1994 | United Kingdom . | |
| WO92/20577 | 11/1992 | WIPO | B65B 1/04 |

*Primary Examiner*—N. Le
*Assistant Examiner*—L. Anderson
*Attorney, Agent, or Firm*—Fitzpatrick, Cella, Harper & Scinto

[57] ABSTRACT

An ink filling method for filling an ink cartridge with ink to be supplied to a recording head for ejecting ink includes providing an ink cartridge having a negative pressure producing material accommodating portion and an ink accommodating portion, the negative pressure producing material accommodating portion accommodating a negative pressure producing material and being provided with an air vent, and the ink accommodating portion being substantially hermetically sealed except for fluid communication with the negative pressure producing material accommodating portion, and accommodating directly the ink to be supplied to the recording head, the ink cartridge further includes a partition wall between the negative pressure producing material accommodating portion and the ink accommodating portion, the partition wall being provided with a gap for permitting formation of meniscus of the ink; and directly injecting the ink into the ink accommodating portion.

5 Claims, 24 Drawing Sheets

INK FILLING METHOD AND APPARATUS FOR INK CARTRIDGE

FIELD OF THE INVENTION AND RELATED ART

The present invention relates to an ink filling method and apparatus for an ink cartridge usable with an ink jet apparatus.

A recording apparatus such as a printer, copying machine, facsimile machine or the like and a recording apparatus used as an output apparatus of a combined electronic apparatuses or work station including computer, word processor or the like, is constituted such that image is recorded on a recording material such as a sheet of paper or plastic material in accordance with image information. The recording apparatuses can be classified into an ink jet type, a wire dot type, a thermal type, a laser beam type and so on on the basis of recording system.

In an ink jet type recording apparatus, ink is ejected onto a recording material through recording means (recording head). It comprises the following advantages. The recording means can be significantly downsized, and fine images can be recorded at a high speed. The recording is possible without particular treatment on plain paper. The running cost is low, and the noise is low because it is a non-impact type apparatus. In addition, it is easy to effect color image recording use different color inks.

Among ink jet recording means, an ink jet recording means (recording head) using thermal energy to eject the ink is advantageous in that high density liquid paths (ejection outlets) can be easily provided by the use of electrothermal transducers, electrodes, liquid passage walls and top plate produced through semiconductor manufacturing process including etching, evaporation, sputtering and so on. Therefore, further downsizing is possible.

An ink container used with the ink jet recording apparatus is required to supply in good order an amount of the ink corresponding to the ejections of the ink through the recording head by the recording operation and is required not to leak the ink through the ejection outlets when the recording operation is not carried out.

Additionally, in the case that the ink container is a replaceable or exchangeable type, it is also required that the mounting and demounting of the ink container is smooth without ink leakage, thus assuring the ink supply to the recording head.

As an example of an ink container usable with an ink jet recording apparatus, Japanese Laid-Open Patent Application No. 87242/1988 (first prior art) discloses an ink jet recording cartridge comprising an ink container, a foamed material therein and a plurality of ink ejection orifices.

With such a container, a negative pressure production and ink retention by the capillary force of the foamed porous material such as polyurethane foamed material in which ink is contained, are possible, so that the ink leakage from the container can be prevented.

However, in the first prior art, the foamed material is required to occupy substantially the entirety of an ink containing portion, so that the amount of the ink contained therein is limited, and the amount of the ink remaining in the foamed material as non-usable ink is relatively large, and therefore, the ink utilization factor is not high. Additionally, detection of the amount of the remaining ink is difficult, and the maintenance of constant negative pressure is difficult during the consumption of the ink.

In the case of the ink cartridge having an ink containing portion into which the foamed material is inserted, a corner or corners may be twisted upon the insertion thereof, as the case may be. If this occurs, the compression distribution of the foamed material is not uniform with the possible result of non-uniform distribution in the ink in the ink containing portion.

In this case, even if a sufficient amount of the ink is still contained, the ink path may be blocked due to the non-uniformity of the negative pressure producing performance. If this occurs, the ink may be ejected improperly and/or, the ink can be easily leaked out upon impact thereto, due to the concentration of the ink adjacent the air vent. Accordingly, high accuracy is required upon the insertion of the foamed material into the ink cartridge, thus imposing difficulty on the manufacturing.

Recently, for the purpose of reducing the running cost, a used-up ink cartridge is refilled with the ink. As for the method of refilling the ink, U.S. Pat. Nos. 4,967,207 and 4,968,998 propose that the pressure in the container is reduced through the air vent, and then the ink is injected using a special ink refilling tube.

However, when the ink is injected in this manner, the ink refilling port is disposed away from the recording head, and the pressure reduction tends to be insufficient when the pump in the apparatus is used to reduce the pressure, and therefore, the ink is not uniformly distributed in the porous foamed material with the result of difficulty in formation of the ink path communicating with the recording head, after the refilling. Additionally, when the ink is refilled to the limit of the containing capacity, the ink may be leaked through the air vent.

Even if an attempt is made to inject the ink through the air vent, the ink flow upon the injection can not be controlled with the result that the pressure of the foamed material reaches to the normal operational state before the completion of the ink injection. When the ink continues to be injected to the limit of the capacity, the ink injection through the air vent becomes not possible because of the balance of the internal pressure of the ink container, or the ink may be discharged with the air through the air vent.

Therefore, the refillable amount of the ink is smaller than the initial ink capacity. Because the ink is not uniformly distributed in the foamed material, there is a possibility that the ink path to the ejection outlets is not easily formed upon the start of the recording operation immediately after the refilling, with the result of longer time required for the initial operations.

If an attempt is made to increase the internal capacity of the ink with the injection variation permitted for the purpose of preventing the above-described ink leakage, results in bulky container, and therefore, the bulky apparatus, against the user's needs. Additionally, the necessity for the sucking device for reducing the pressure in the ink cartridge leads to the large size of the recording apparatus and the refilling apparatus.

Accordingly, with the structure in which the porous material occupies the entirety of the inside of the ink containing portion of an ink cartridge, the ink containing efficiency, that is, the amount of the contained ink per unit volume, is low.

As an ink cartridge having a high ink containing efficiency, Japanese Laid-Open Patent Application No. 522/1990 (second prior art) discloses an ink jet recording cartridge in which the porous materials are disposed between a first ink container and a second ink container, and between a second ink container and an ink jet recording head.

This ink jet recording cartridge, the porous material is not contained in the ink containing portion, but it is disposed only in the ink passage, by which the ink capacity is larger than that of the first prior art. Additionally, by the provision of the second ink container, the ink distribution and the air flow are adjusted during the recording operation or upon temperature rise, thus stabilizing the vacuum in the recording head.

However, in the second prior art, the porous material contains a large amount of the ink since it is disposed in the ink passage, and therefore, the negative pressure or vacuum by the capillary force of the porous material is not sufficient, when the recording operation is not carried out, with the result that the ink tends to leak through the ejection outlets of the ink jet recording head upon significant impact.

When the ink is refilled in such an ink cartridge as not provided with an air vent, the pressure of the ink cartridge is reduced, and the ink is injected through a port other than the air vent.

In this case, the ink container is required to be hermetically closed to maintain the negative pressure of the ink cartridge, and therefore, the ink is supplied through the ejection outlets of the recording head with the result of long ink supplying period.

Japanese Patent Applications Nos. (corresponding to British Appln. 2,268,910 and U.S. application Ser. No. 08/094,313, filed Jul. 21, 1993, now U.S. Pat. No. 5,619,238); and 198681/1992 (published as Japanese Laid-Open Appln. 6-40043 and British Appln. 2,268,911, and corresponding to U.S. application Ser. No. 08/094,317, filed Jul. 21, 1993, now U.S. Pat. No. 5,509,145) propose an ink container particularly suitable for ink jet printing from the standpoint of stability of the vacuum which is peculiar to the ink jet recording. With this ink container, the ink can be properly supplied corresponding to the amount of the ink ejected from the recording head during the printing operation, and simultaneously, the ink leakage through the ejection outlets can be properly prevented when the printing operation is not carried out.

The container fundamentally comprises a first chamber (negative pressure generating material container) accommodating a negative pressure generating material and provided with an air vent and an ink supply port for supplying the ink out, and a second chamber (ink container) substantially hermetically sealed except for fluid communication with the first chamber and directly containing the ink to be supplied to the first chamber. This is particularly effective for an ink jet recording apparatus (this structure will be called "starting structure").

With this structure, the vacuum can be maintained substantially constant almost all of the period from the start of use to the end of the head cartridge, and therefore, it can be used for high speed printing.

In addition, the ink jet recording is used in wide range, for example, facsimile machine or another communication field, a large size sheet copying machines, textile printing, as well as usual printer. Because of this, a large ink container and ink refilling are desired.

SUMMARY OF THE INVENTION

Accordingly, it is a principal object of the present invention to provide an ink filling method for an ink cartridge having the above-described starting structure.

It is another object of the present invention to provide an ink filling method by which the ink can be quickly filled.

It is a further object of the present invention to provide an ink filling method in which air bubbles in an ink containing portion during the ink filling operation is suppressed, and the hermetically closed ink containing portion is substantially completely filled with the ink.

It is a further object of the present invention to provide an ink filling method in which the ink is not leaked during the ink filling operation.

According to an aspect of the present invention, there is provided an ink filling method for filling an ink cartridge with ink to be supplied to a recording head for ejecting ink, comprising: providing the ink cartridge having a negative pressure producing material accommodating portion and an ink accommodating portion, the negative pressure producing material accommodating portion accommodating a negative pressure producing material and being provided with an air vent, and the ink accommodating portion being substantially hermetically sealed except for fluid communication with the negative pressure producing material accommodating portion, and accommodating directly the ink to be supplied to the recording head, the ink cartridge further includes a partition wall between the negative pressure producing material accommodating portion and the ink accommodating portion, the partition wall being provided with a gap for permitting formation of meniscus of the ink; and directly injecting the ink into the ink accommodating portion.

According to a second aspect of the present invention, there is provided an ink supply method according to the first aspect wherein during ink injecting operation, the gap takes a topmost position of the ink accommodating portion.

According to a third aspect of the present invention, there is provided an ink filling method in which the ink is injected through an ink ejection port of an ink containing portion.

According to a fourth aspect of the present invention to provide an ink filling method according to the first aspect wherein the ink is injected by ink injecting means in fluid communication with an ink container for containing the ink to be injected, wherein the ink injection means is inserted through an ink supply port for supplying the ink out of the ink cartridge, into the ink cartridge, and an opening of the ink injection means is projected into the ink accommodating portion.

According to a fifth aspect of the present invention, there is provided an ink filling method according to the fourth aspect, wherein the ink injection means is provided with air discharging means for discharging air out of the ink accommodating portion.

According to a fifth aspect of the present invention, there is provided an ink filling method according to the fourth aspect, wherein the ink injection means has an opening for supplying the ink into the negative pressure producing material accommodating portion.

According to a further aspect of the present invention, there is provided an ink filling apparatus for filling an ink cartridge with ink to be supplied to a recording head for ejecting ink, wherein the ink cartridge has a negative pressure producing material accommodating portion and an ink accommodating portion, the negative pressure producing material accommodating portion accommodating a negative pressure producing material and being provided with an air vent, and the ink accommodating portion being substantially hermetically sealed except for fluid communication with the negative pressure producing material accommodating portion, and accommodating directly the ink to be supplied to the recording head, the ink cartridge further includes a partition wall between the negative pressure producing material accommodating portion and the ink accommodating portion, the partition wall being provided with a gap for permitting formation of meniscus of the ink, the apparatus comprising: an injection member for directly injecting the ink into the ink accommodating portion; and means for supplying the ink to the injection member; wherein the injection member is injectable into the negative pressure producing material accommodating portion, and the injection member is long enough to an end opening thereof is in the ink accommodating portion through the gap, when the injection member is inserted into the ink cartridge through the ink supply port.

According to an ink filling method of the present invention, an air-liquid interface is formed at a proper position, so that a large capacity ink cartridge can be reused a plurality of times with stabilized negative pressure.

According to the ink filling method of the present invention, the ink filling operation can be completed for a short period of time.

According to the ink filling method of the present invention, the occurrence of the air bubbles in the ink containing portion can be suppressed, and the ink accommodating portion hermetically sealed can be substantially completely filled with the ink.

According to the ink filling method of the present invention, the ink cartridge can be reused without ink leakage when the ink is refilled.

According to an ink filling apparatus of the present invention, an air-liquid interface can be formed at a proper position, so that the ink cartridge can be reused a plurality of times without deterioration of the performance of the ink cartridge.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 3A and 3B represent normal recording, and FIG. 3C represents the case of shortage of the ink.

FIG. 30A shows an ink injection means, and FIGS. 30B and 30C illustrate positions during ink cartridge filling operation.

DESCRIPTION OF THE PREFERRED EMBODIMENTS

Figure 1A:
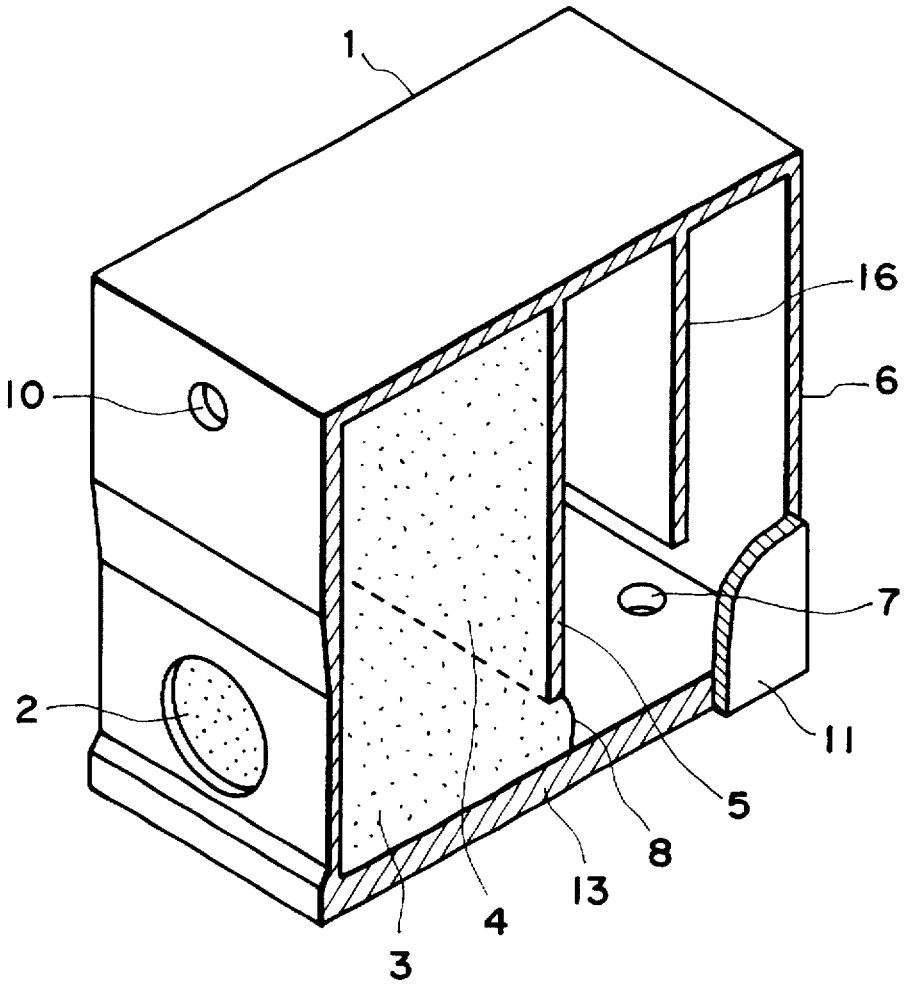
FIGS. 1A and 1B are partly broken perspective views of an ink cartridge usable with a present invention.
Figure 1B:
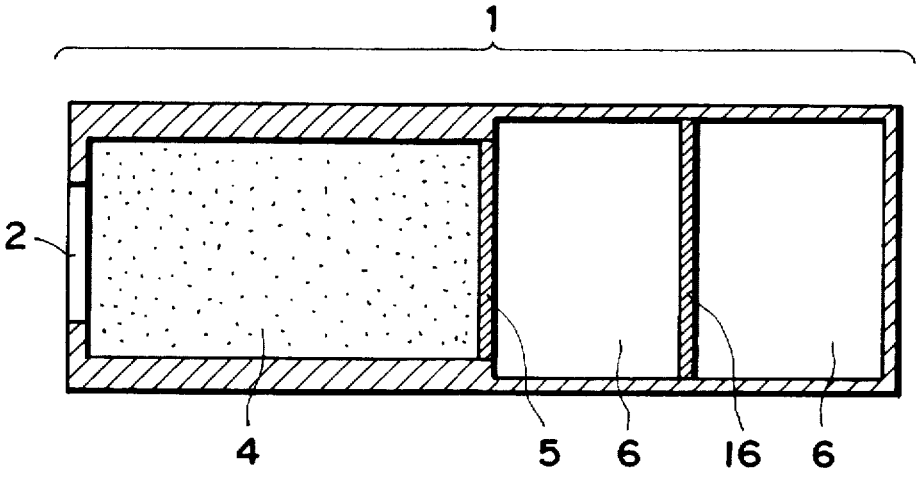

FIGS. 1A and 1B are a perspective view and a sectional view of an example of an ink cartridge to which the present invention is applicable.

As shown in these Figures, a main body 1 of the ink cartridge comprises a negative pressure producing material accommodating portion 4 and an ink accommodating portion 6. The former is provided with an opening (ink supply port) 2 for connection with an ink jet recording head and an air vent 10 for introduction of ambient air, disposed at a level higher than that of the opening 2, and accommodates a negative pressure producing material 3 of a porous material for absorbing and retaining recording ink. The ink accommodating portion 6 is disposed adjacent to the material accommodating chamber 4 through a partition wall (partition member) 5, and functions to contain the ink. The ink accommodating portion 6 and the material accommodating portion 4 are in fluid communication with each other through a clearance or gap 8 formed between a rib 5 and a bottom surface of the container. The ink accommodating portion 6 is provided with a partition plate (reinforcing plate) 16, which bridges between opposite side walls with a clearance remaining at the bottom, the clearance being larger than the clearance 8.

The ink cartridge is provided with an ink injection inlet 7 for permitting supply of ink into the ink accommodating portion 6. The ink injection inlet 7 is formed in a bottom surface adjacent to the clearance 8.

After the ink is injected through the ink injection port 7, it is sealed by proper means. The method of injection will be described in detail hereinafter.

It is possible to refill the ink in the ink accommodating portion through the ink injection port 7.

Figure 2:
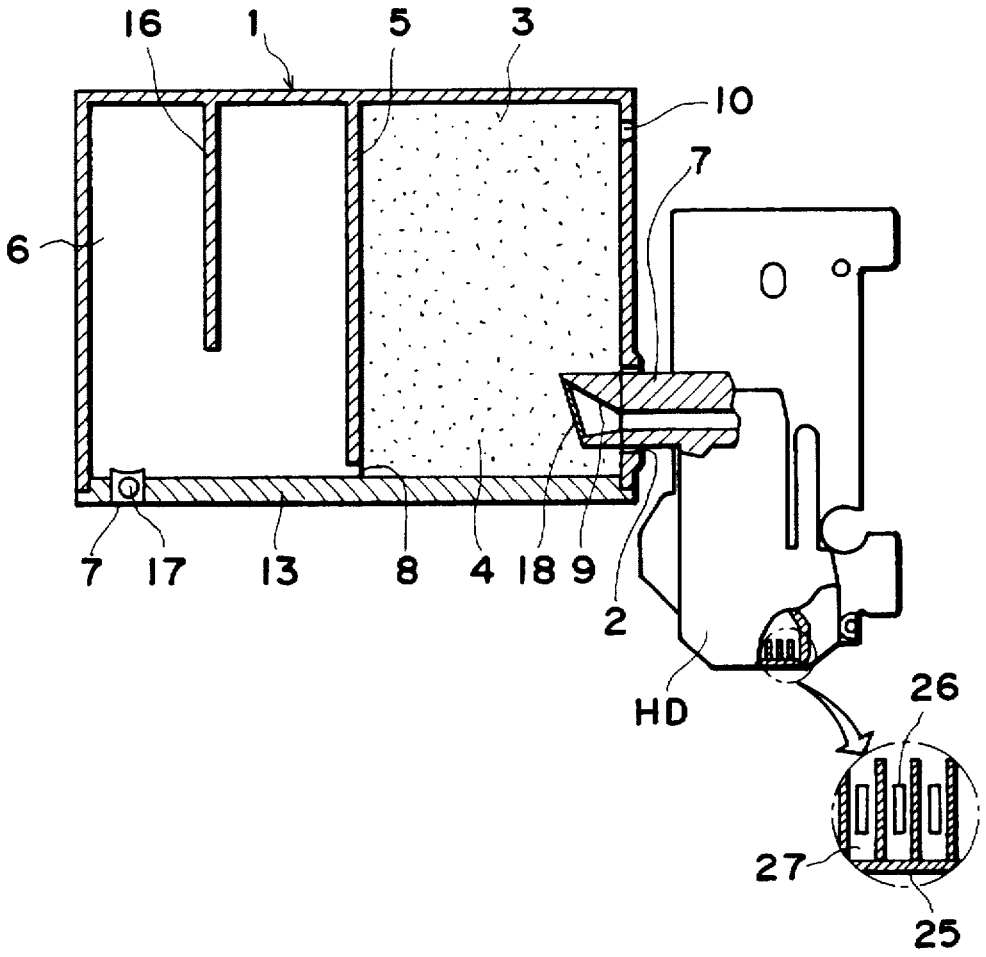
FIG. 2B is a sectional view of an ink cartridge of FIG. 1 mounted to a recording head.

FIG. 2 illustrates the ink cartridge of FIG. 1 mounted to a recording head. In FIG. 2, the same reference numerals as in FIG. 1 are assigned to the elements having the corresponding functions. The ink injection inlet 7 is sealed by a sealing member 17. The recording head is provided with ejection outlets 25, heat generating elements 26 and liquid passages 27 as the elements for ink ejection. In this embodiment, thermal energy is produced by the heat generating elements 26 in the liquid passage 27, and a change of state is caused in the ink by the thermal energy, thus ejecting the ink through an ejection outlet 25 of the recording head HD.

The recording head usable with the ink cartridge to which the present invention is applicable may be another type, for example, piezoelectric element type.

In this embodiment, the ink supply from the ink cartridge to the recording head is permitted by press-contacting to the negative pressure producing material an ink supply tube 9 having a filter 18 at the end thereof in the recording head.

In consideration of this, it is desirable that the ink is distributed to the neighborhood of the opening 2 of the ink cartridge.

Figure 3A:
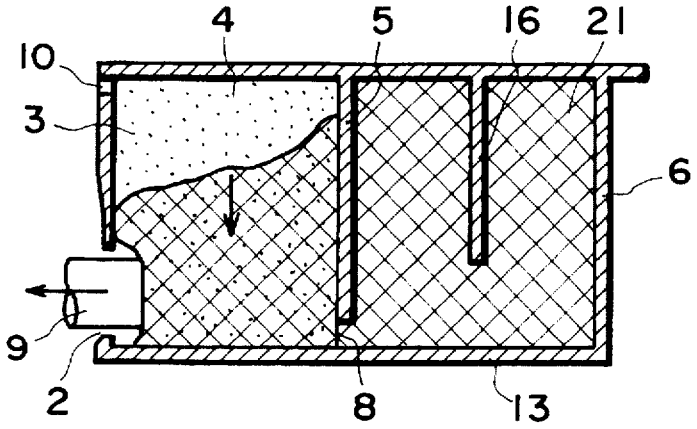
FIGS. 3A, 3B and 3C illustrate a distribution of ink when the ink cartridge shown in FIGS. 1 and 2 is mounted to a recording head, and the recording operation is carried out.
Figure 3B:
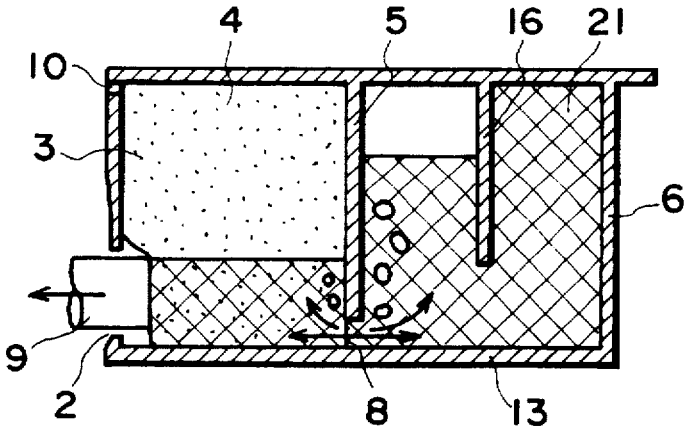
Figure 3C:
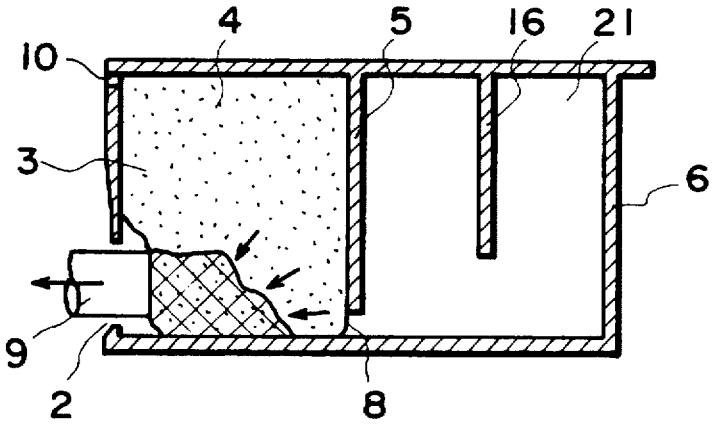

Referring to FIGS. 3A, 3B and 3C, the description will be made as to an ink supply when the ink cartridge is connected with the recording head.

In FIG. 3A, the ink supply tube 9 is shown as having been press-contacted to the negative pressure producing material 3 through an opening 2 of the cartridge 1. Therefore, the ink jet recording apparatus is in an operative state. In this embodiment, the ink supply tube 9 is provided with the filter to remove foreign matters in the ink cartridge.

[Operation]

When the ink jet recording apparatus is operated, ink is ejected through orifices of the ink jet recording head, and as a result, ink absorbing force is produced in the ink container. The absorbing force supplies the ink 21 to the ink jet recording head through the gap 8 between the partition wall 5 and the bottom of the ink cartridge 13, the material accommodating portion 4, the negative pressure producing material 3 and the ink supply tube 9. By this, the internal pressure of the ink accommodating portion 6 which is hermetically sealed except for the gap 8 decreased with the result of pressure difference between the ink accommodating portion 6 and the negative pressure producing material accommodating portion 4. With the continuing ejections, the pressure difference continues to increase, but since the material accommodating portion 4 is open to the ambience through the air vent 10, the ambient air is introduced into the ink accommodating portion 6 through the negative pressure producing material 3 and through the gap 8, as shown in FIG. 3B, so that the air-liquid exchange occurs. Thus, the pressure difference between the ink accommodating portion 6 and the material accommodating portion 4 is removed. During the ink jet recording operation, this is repeated so that a predetermined negative pressure is maintained in the ink cartridge. Substantially of the ink in the ink accommodating portion 6 can be consumed except for the ink deposited on the wall surface of the ink accommodating portion 6, and therefore, the ink utilization factor is improved (FIG. 3C).

When the recording operation is not carried out, the capillary force of the negative pressure producing material 3 (or the meniscus force at the interface between the ink and the negative pressure producing material) is effective to prevent leakage of the ink from the ink jet recording head.

As described above, the air-liquid exchange is repeated through the gap during the ink supply process. Before the introduction of the air into the ink accommodating portion through the gap, a small quantity of the ink is supplied toward the recording head from the material accommodating portion.

With the decrease of the quantity of the ink in the material accommodating portion, the interface between the air and the liquid changes. When a part of the air-liquid interface reaches to the gap, the air is introduced into the ink accommodating portion.

The change of the quantity of the ink retained in the material accommodating portion is influential to the negative pressure applied to the recording head, and therefore, it is desirable that the air is introduced into the ink accommodating portion without lowering of the air-liquid interface during the air-liquid exchange step through the gap.

In the following embodiment, the introduction of the air into the ink accommodating portion, that is, the air-liquid exchange can be performed with suppressed positional change of the air-liquid interface.

Figure 4:
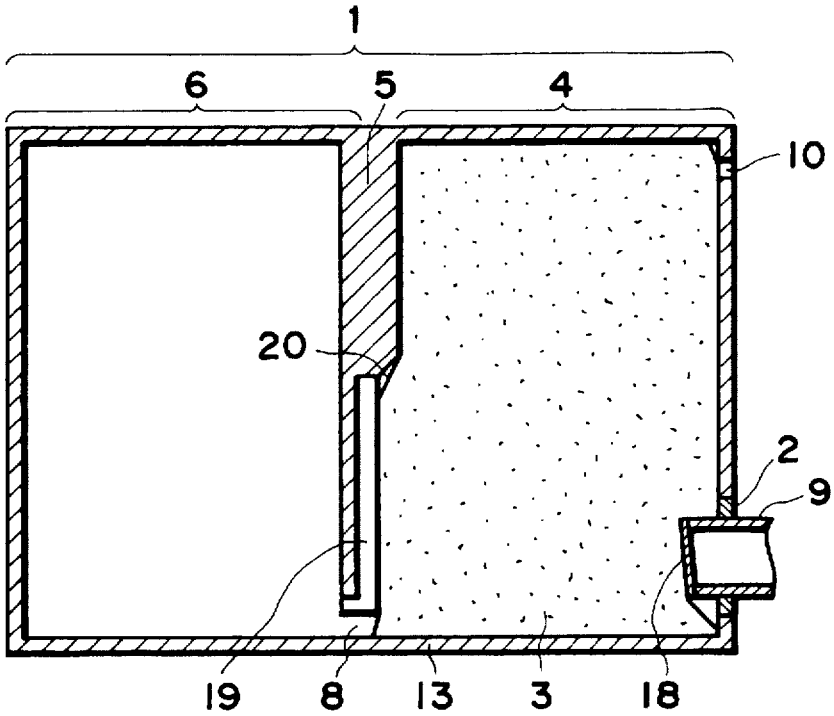
FIG. 4 is a longitudinal sectional view of another ink cartridge to which the present invention is applicable.
Figure 6:
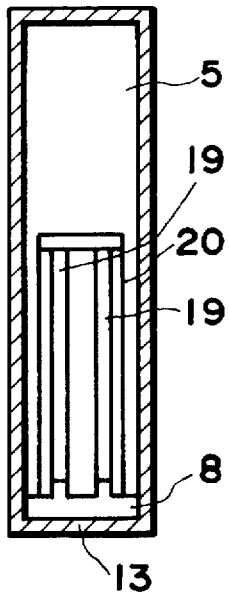
FIG. 6 is a longitudinal view in another direction of the ink cartridge shown in FIG. 4.
Figure 5:
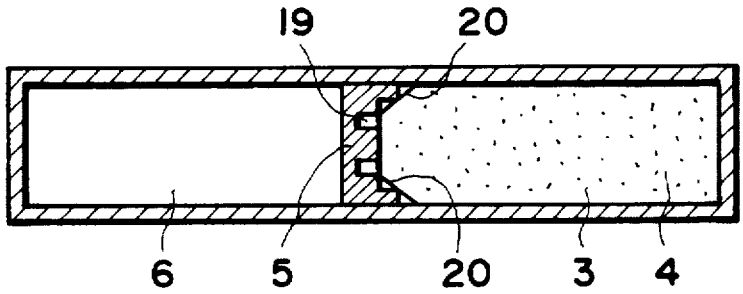
FIG. 5 is a cross-sectional view of the same ink cartridge.

FIGS. 4, 5 and 6, illustrate this embodiment. FIG. 4 is a longitudinal sectional view of the ink cartridge body, FIG. 5 is a cross-sectional view thereof, and FIG. 6 illustrates air-liquid interface variation suppressing mechanism, as seen from the material accommodating portion.

The main body 1 is provided with air introducing grooves 19 and negative pressure producing material adjusting portions 20.

The air introducing grooves 19 are formed at the material accommodating portion 4 side and are extended from a middle portion of the partition wall 5 to an end of the partition wall 5, that is, to the gap 8. Negative pressure producing material adjusting chambers 20 are provided by the partition wall 5 and the material 3 itself, adjacent the air introducing grooves 19. The material 3 is contacted to an inner surface of the material accommodating portion 4. Therefore, even if the material 3 is inserted non-uniformly, the contact (compression) pressure to the material 3 is partially eased, as shown in FIGS. 4 and 5. For this reason, when the ink is used by the recording head, the ink contained in the material 3 is consumed and is reached to the adjusting portion 20. With the continued consumption of the ink, the ink meniscus being easily broken by the air at the portion where the contact pressure is eased by the adjusting portions 20, so that the air is introduced smoothly into the grooves 19, thus making the negative pressure control easier.

[Manufacturing method]

Figure 7:
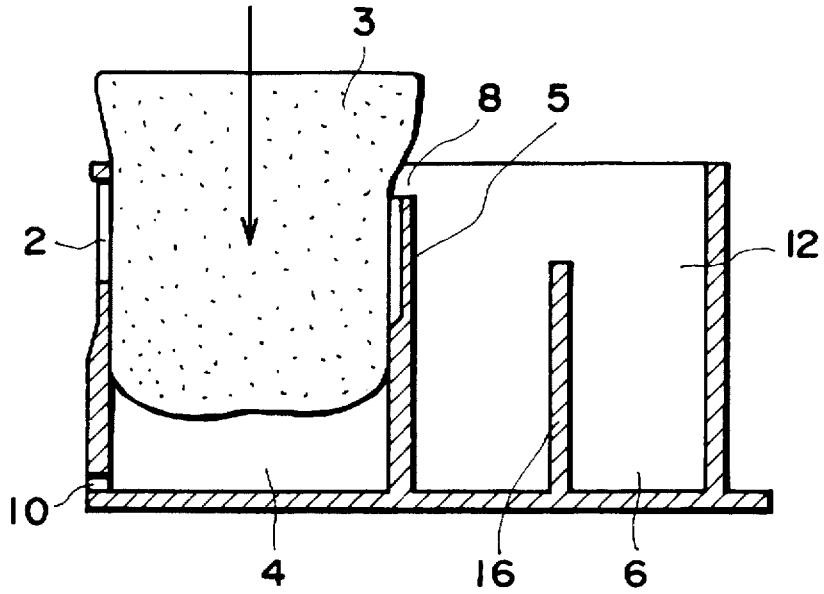
FIG. 7 is a sectional view of an ink cartridge illustrating manufacturing steps of an ink cartridge with which the present invention is usable.
Figure 8:
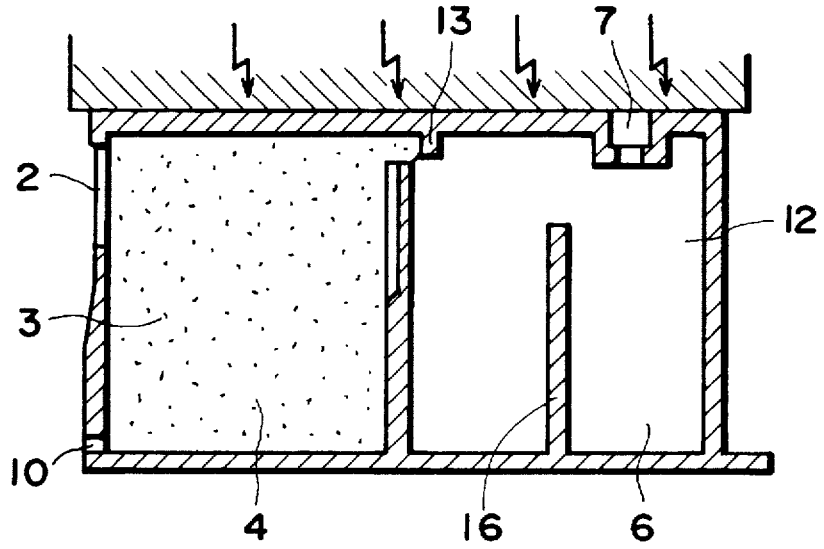
FIG. 8 is similar to FIG. 7, but shows another step of manufacturing.

Referring to FIGS. 7 and 8, the manufacturing method of an ink cartridge of the above structure will be described.

An ink cartridge 12 is molded of polypropylene material and is provided with the negative pressure producing material accommodating portion 4, a sponge of polyurethane foamed material or the like as the negative pressure producing material 3 for retaining the ink and for producing the negative pressure, is inserted. The material may be a sponge like or porous material of fibers or knit. In this embodiment, the polyurethane foamed material is used because the negative pressure level can be relatively easily adjusted.

A cover 13 constituting a bottom of the cartridge, from which the sponge is inserted, is fixed by ultrasonic wave or high frequency wave by fusing both of the materials, as shown in FIG. 8. To facilitate this, the materials of the cover and the main body are the same.

A predetermined quantity of the ink is injected through the ink injection inlet 7 formed in the ink accommodating portion 6 of a vacant ink cartridge thus manufactured.

Figure 9:
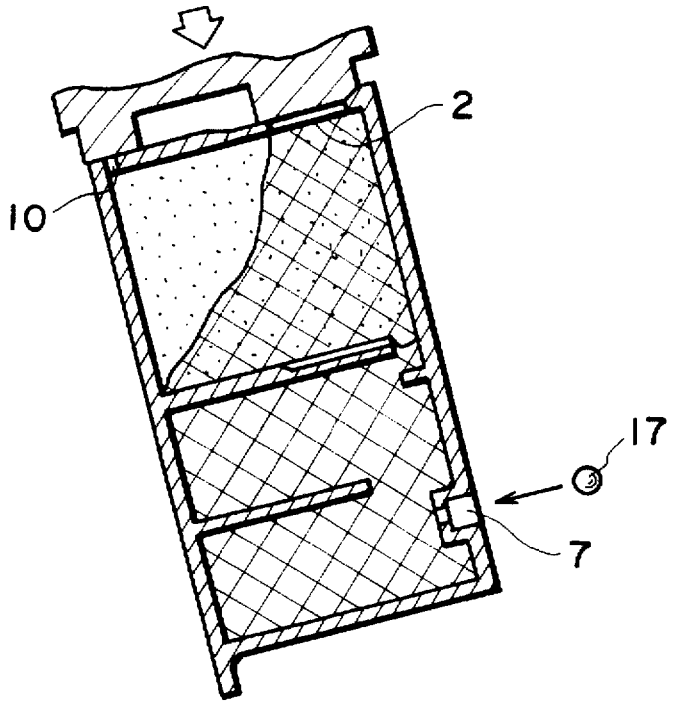
FIG. 9 is a sectional view of an ink cartridge, illustrating ink ejection port sealing step after the ink is filled.
Figure 10:
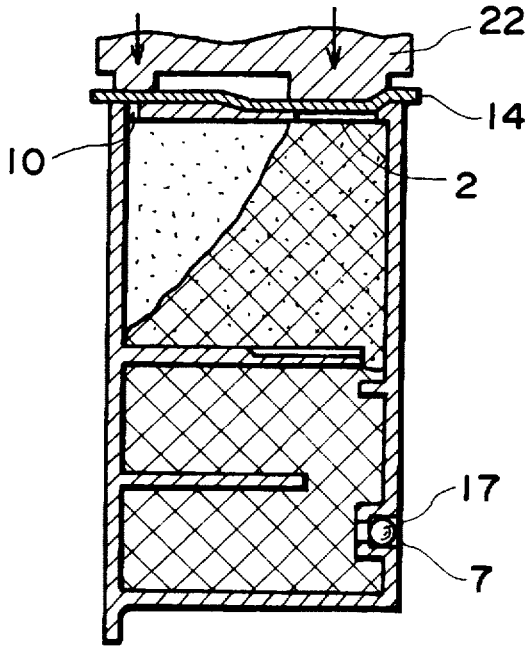
FIG. 10 is a sectional view, illustrating a sealing step for an ink cartridge.

Referring to FIGS. 9 and 10, an ink cartridge sealing step will be described.

After the completion of the ink ejection, the opening 2 and the air vent 10 are sealed by proper means soon, as shown in FIG. 9. Thereafter, an ink supply outlet of an ink supply apparatus is removed from the ink injection inlet 7, and then, a spherical plug 17 of plastic material or metal is press-fitted into the ink injection inlet 7.

Figure 11:
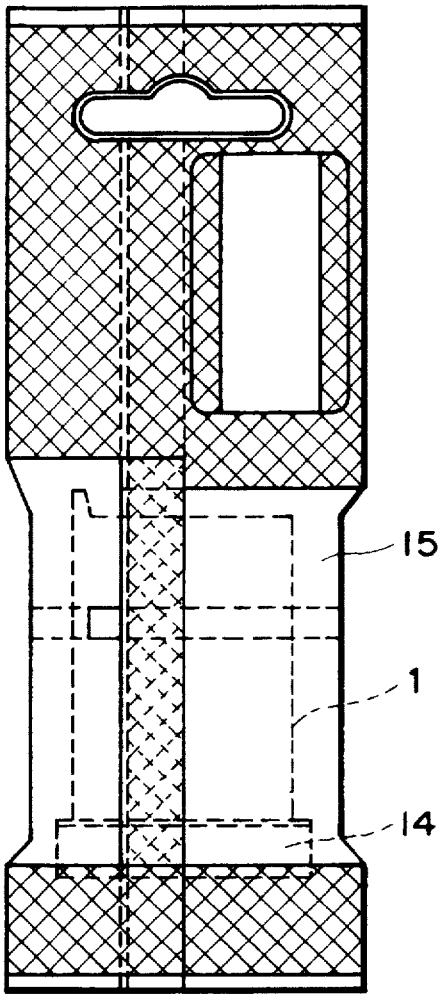
FIG. 11 illustrates a package containing an ink cartridge to which the present invention is applicable.

Subsequently, as shown in FIG. 10, the opening 2 and the air vent 10 are heat-sealed with a plastic resin film 14 having a multi-layer structure including an intermediate layer of evaporated aluminum, by a heat fusing machine 22. This is effective to prevent ink leakage and ink evaporation during transportation of the ink cartridge. As shown in FIG. 11, the ink cartridge is packed, by heat sealing, with a multi-layer packing film 15 of plastic material having printed information at the outside thereof.

The material of the ink cartridge 1 may be transparent or semi-transparent plastic material such as nylon, polyethylene or polypropylene, then, the remaining quantity of the ink can be externally confirmed, and therefore, the ink cartridge exchanging timing can be discriminated.

The position of the opening for the ink ejection and the timing of the formation of the opening, are determined depending on the method of ink injection. Under the condition that proper injection method is usable, the position of the injection opening can be any, and it may be formed upon the injection, or it may be formed beforehand, and sealed, in which case, the sealing is removed upon the ink injection.

In this embodiment, the opening is formed in a wall of the ink accommodating portion adjacent the gap. The position is determined so that an ink ejection method is usable. The reasons will be described.

When the ink is injected through a conventional method into an ink cartridge to which the embodiments of the present invention are applicable, the ink will be injected through the air vent formed in the material accommodating portion or an ink supply port for supplying the ink to the recording head.

However, the ink injection through the air vent will result in the existence of the ink adjacent the air vent. Then, an ink path leading to the air vent is easily formed upon pressure increase in the cartridge due to the ambient temperature change or the like, and therefore, the ink leakage may easily occur.

For this reason, the ink injection through the air vent is not preferable for the ink cartridge having the starting structure described in the introductory part of this specification.

Figure 12:
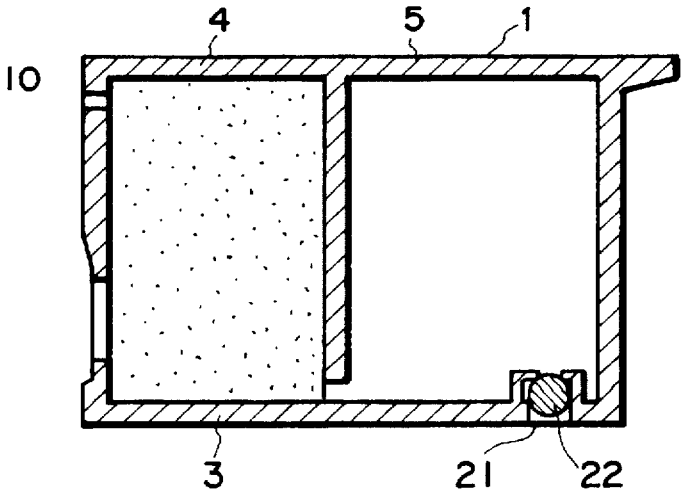
FIG. 12 is a sectional view of an example of an ink cartridge to which the present invention is applicable.

On the other hand, the ink injection through an ink supply port involves the following problems. FIG. 12 illustrates an ink cartridge to which the present invention is applicable. As described hereinbefore, in order to stabilize the negative pressure in the ink cartridge, a gap for permitting ink meniscus formation is provided.

The gap shown in FIG. 12 takes a bottom position, when the ink cartridge is mounted on an ink jet apparatus.

When the ink is injected through the ink supply port with this position, the ink is first absorbed by the negative pressure producing material, and only then, the injected ink reaches the gap. At this time, the ink forms a meniscus in the negative pressure producing material of porous material adjacent the gap, and therefore, not all of the injected ink is contained in the ink accommodating portion, but the ink is not supplied into the ink accommodating portion any more after the ink is accommodated to such an extent that the gap is filled with the ink. This is because there occurs no air-liquid exchange corresponding to the ink injection into the ink accommodating portion, with the result that the ink accommodating portion is completely sealed with the air remaining therein.

Therefore, even if the ink is injected through an ink supply port with the gap taking the bottom position as shown in FIG. 12, the quantity of the ink supplied into the ink accommodating portion is small, and therefore, the method is not practical.

In the case that the ink is injected after the pressure in the ink cartridge is reduced with the state of FIG. 12, the ink is distributed uniformly also in the material accommodating portion, and therefore, the ink reaches the neighborhood of the air vent.

When the negative pressure producing material is completely filled with the ink, the meniscus formation in the porous material is not sufficient so that the negative pressure is not sufficient with the result that the ink is leaked when the ink cartridge is connected to the recording head.

In the foregoing, the ink is injected when the gap takes the bottommost position. However, the inventors have conceived that the ink is injected while the gap takes the topmost position. In this case, the air-liquid exchange is permitted through the gap.

Figure 13A:
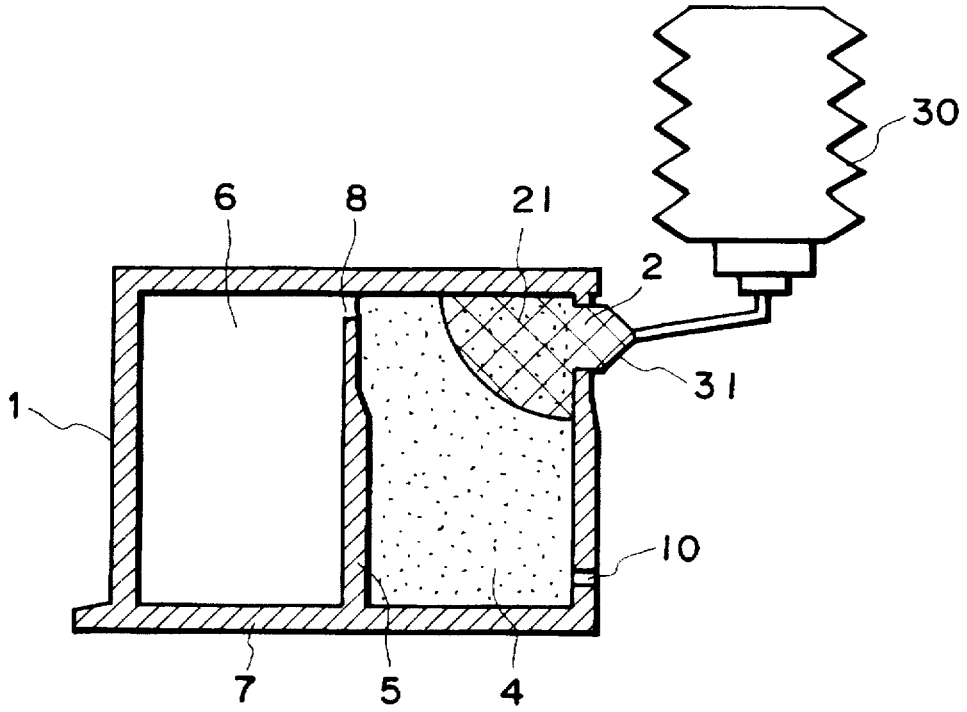
FIGS. 13A and 13B are sectional views, illustrating an example of an ink filling method to the ink cartridge of FIG. 12.
Figure 13B:
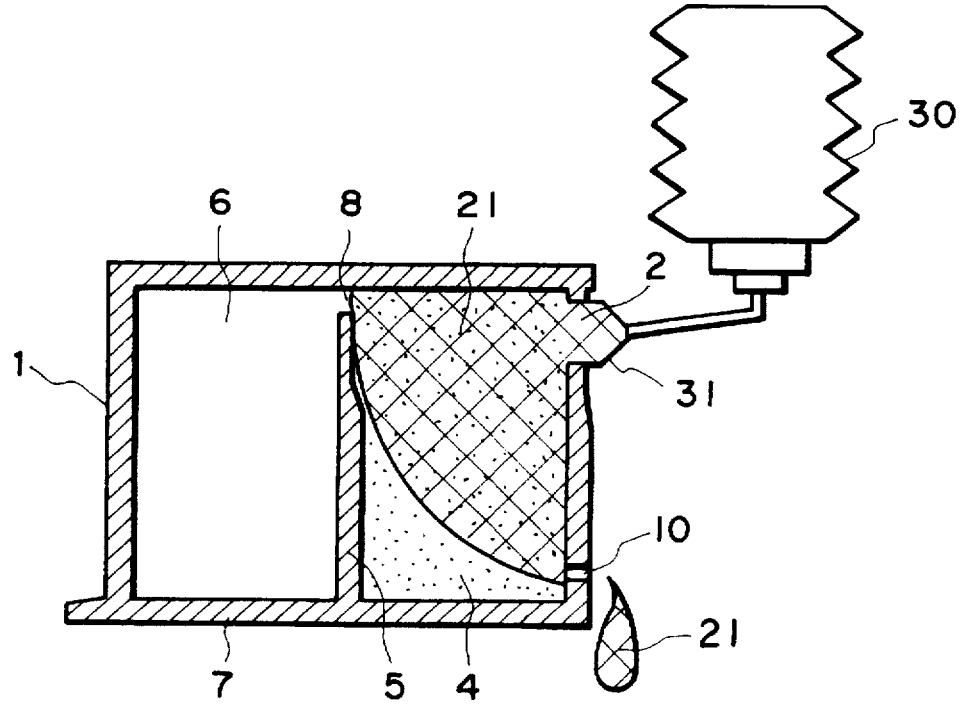

Referring to FIG. 13, ink refilling using the above-described method is illustrated. The ink cartridge body 1 is placed up side down. An in supply joint 31 is pressed to the opening, and the bellows of an ink refilling container 30 are compressed so that the ink is injected into the cartridge. At the first stage, as shown in FIG. 13A, the ink 21 expands in the negative pressure producing material. When the ink is further injected, the ink expands the entirety of the negative pressure producing material 4, until the ink meniscus is formed in the negative pressure producing material at the gap 8, so that the gap 8 is closed. In order to supply the ink in the ink accommodating portion 6, the air is required to be discharged through the air vent 10 with the entering of the ink into the ink accommodating portion. However, since the gap 8 is closed by the ink, the ink does not enter the ink accommodating portion 6, and the ink is injected into the negative pressure producing material only. As shown in FIG. 13B, the ink finally leaks through the air vent 10, and is discharged therethrough. Thus, the ink enters the ink accommodating portion only when the ink meniscus at the gap 8 is broken, and therefore, the ink filling efficiency is not good. This is not preferable from the standpoint of the ink capacity and the ink leakage.

A s described in the foregoing, it is not impossible to inject the ink from the negative pressure producing material accommodating portion (first chamber) without opening an ink refilling port in an ink accommodating portion (second chamber). However, the ink cartridge to which the present invention is related is provided with a fine communicating part, and in the case that the meniscus of the ink is formed in the communicating part, the second chamber is hermetically sealed, and therefore, even if a space remains in the second chamber, the ink injection is no longer possible, with the result that the ink leaks out through the air vent of the first chamber.

As will be understood, it is quite difficult to fill the ink accommodating chamber with the ink by ink injection through the above-described opening.

According to an embodiment of the present invention, the ink is supplied first into the ink accommodating portion.

The timing of the ink refilling may be any, but in consideration of the function of the ink cartridge after the refilling of the ink, the ink is preferably injected while the ink still remains in the second chamber. The reason is as follows. Once the ink path in the porous negative pressure generating material, is once broken, the reformation of the ink path is difficult. In addition, during the recovery process, a substantial amount of ink is consumed wastefully. Additionally, in consideration of the leakage of the ink remaining in the second chamber and the ink refilling efficiency, the refilling is preferably carried out immediately before the ink in the second chamber is used up.

Figure 14:
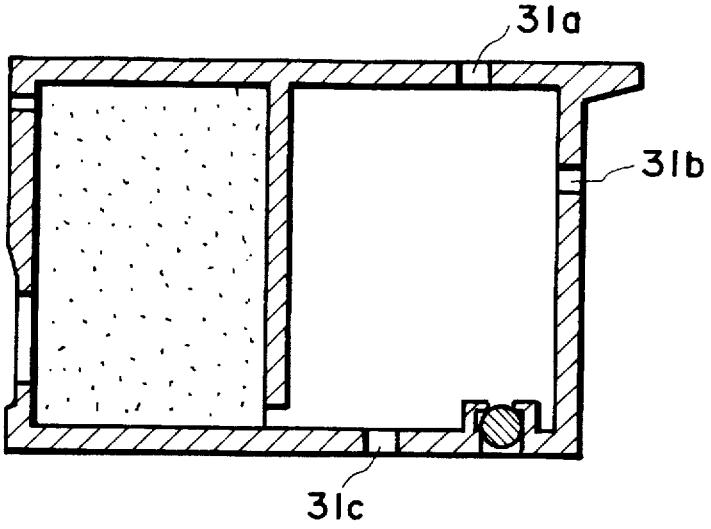
FIG. 14 is a sectional view of an ink cartridge of FIG. 12, in which an ink injection port is provided.

FIG. 14 shows a sectional view in which an ink refilling port is opened. The position of the refilling port may be any, if it is in a wall of the second chamber. However, in consideration of the easiness of the ink ejection or the ink leakage through the ink refilling port during reuse in an ink jet recording apparatus, it is preferably formed in a top portion of the ink cartridge, as indicated by reference numeral 31*a* or 31*b* in FIG. 14. The number or configuration thereof are not limited.

Figure 15:
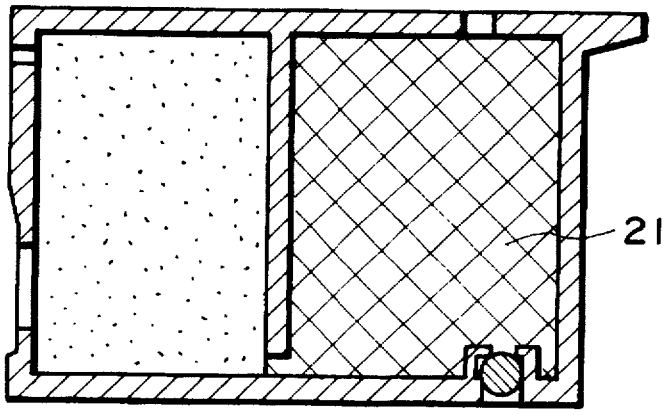
FIG. 15 is a sectional view, illustrating ink refilling.
Figure 16:
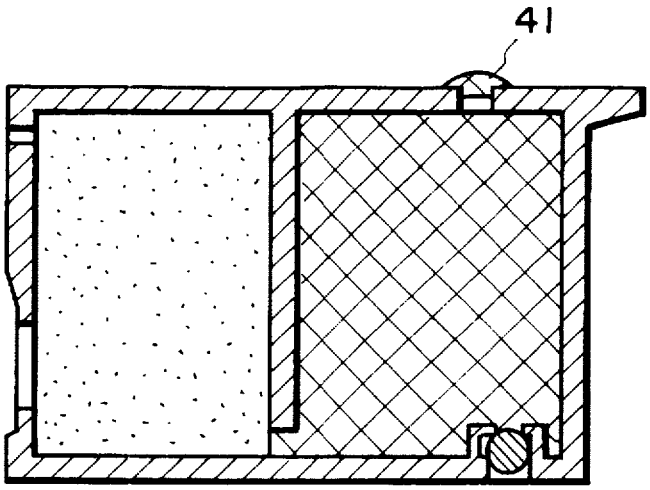
FIG. 16 is a sectional view of an ink cartridge, illustrating sealing after the ink refilling.
Figure 17:
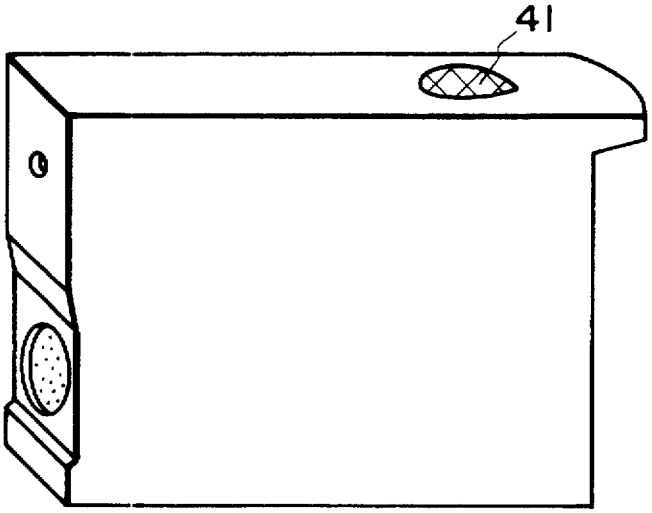
FIG. 17 is a perspective view of the ink cartridge shown in FIG. 16.

FIG. 15 shows a state in which the ink 21 has been refilled through one ink refilling port 31*a*. The ink refilling can be performed using any proper means. For example, the ink may be sucked by an injector, and the ink is injected through the refilling port. Thereafter, the ink refilling port in the second chamber is sealed by a sealing member 41 as shown in FIGS. 16 and 17, so that the second chamber is sealed. Thus, the ink refilling is completed. Another advantage of this embodiment appears while the ink cartridge is being reused. The ink cartridge used in this embodiment maintains the vacuum (negative pressure) in the second chamber, so that the sealing member 41 for the ink refilling port is strongly attracted to the ink cartridge, thus prohibiting the opening of the port.

The sealing member for the ink refilling port may be of a known material such as metal, plastic resin material or elastic rubber material.

Figure 18A:
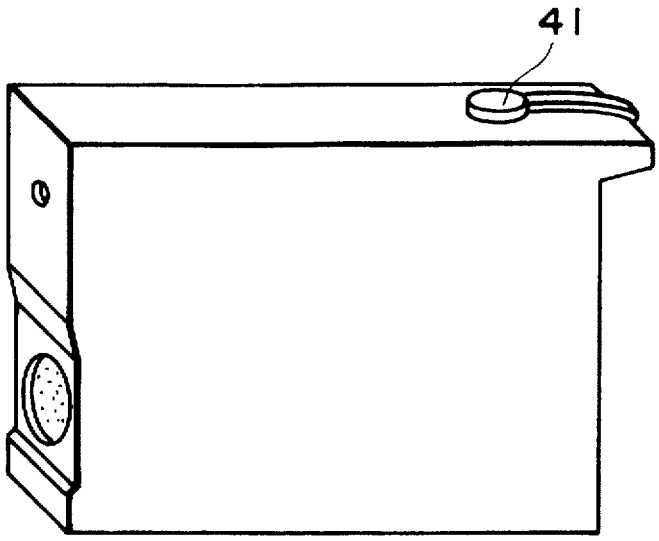
FIGS. 18A and 18B are sectional views, illustrating sealing after the ink refilling.
Figure 18B:
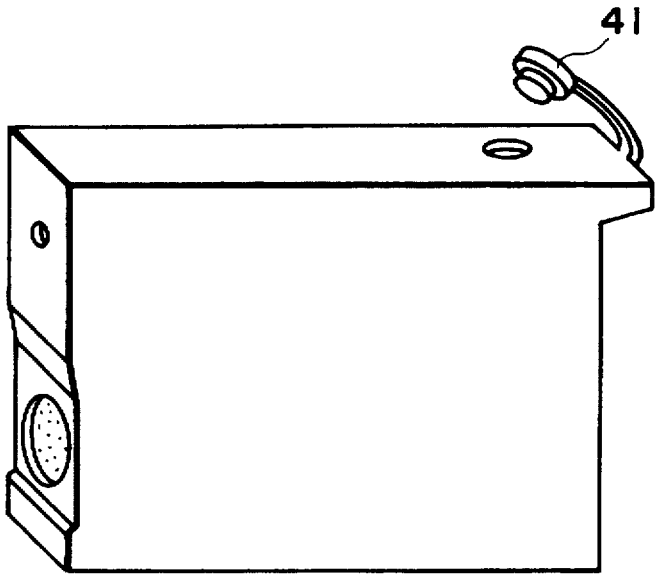

Referring to FIGS. 18 and 19, there are shown other sealing methods for the refilling port. In an example of FIG. 18, the plug is integral with the ink cartridge. This eliminates the necessity of the user to drill the injection port and the necessity for preparing a sealing member, and therefore preferable. The material thereof is preferably adhesive high polymer such as adhesive material, sticky material or sealing material.

Figure 19A:
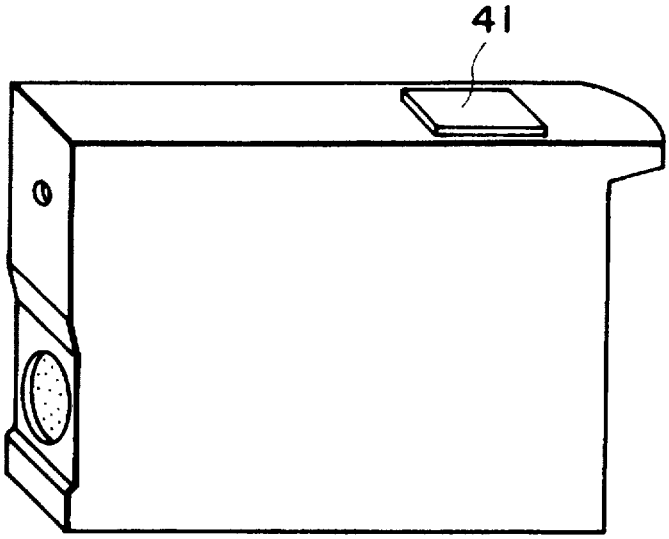
FIGS. 19A and 19B are sectional views, illustrating sealing after the ink refilling operation.

To permit repeated use of the ink cartridge, the sealing member is preferably a sheet with adhesive material such as an adhesive tape or sealing tape, as shown in FIG. 19A.

Figure 19B:
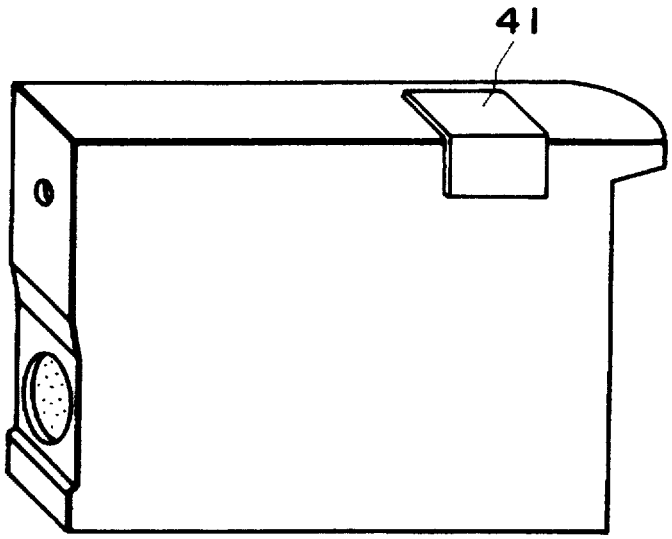

In order to permit the repeated reuse and in order to enhance the sealing of the second chamber, the sealing member preferably extends onto a side other than the side having the ink refilling port, as shown in FIG. 19B. Another sealing is usable.

As described above, the ink refilling port may be formed through known means.

Figure 20:
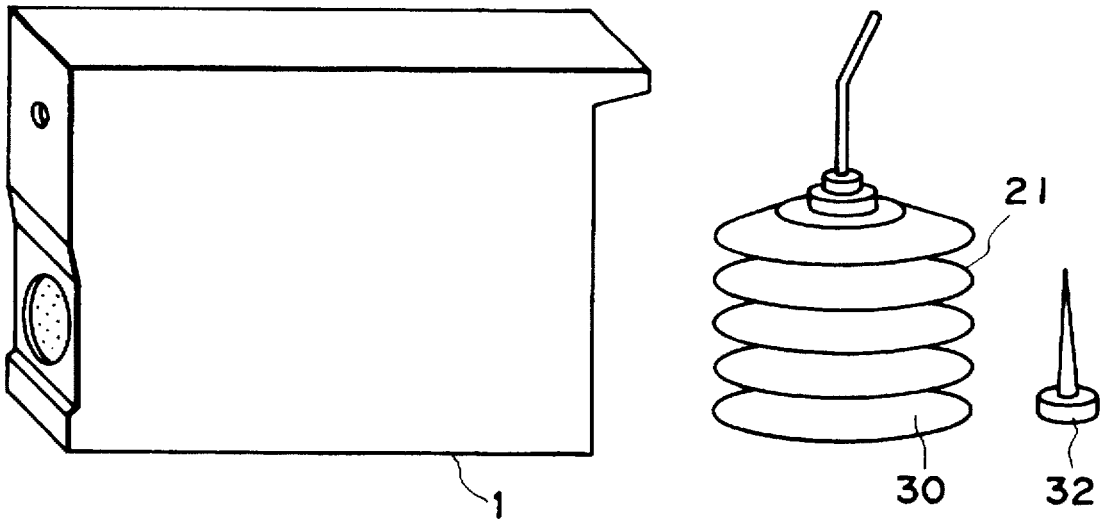
FIG. 20 is a sectional view, illustrating a refilling method according to an embodiment of the present invention.
Figure 21:
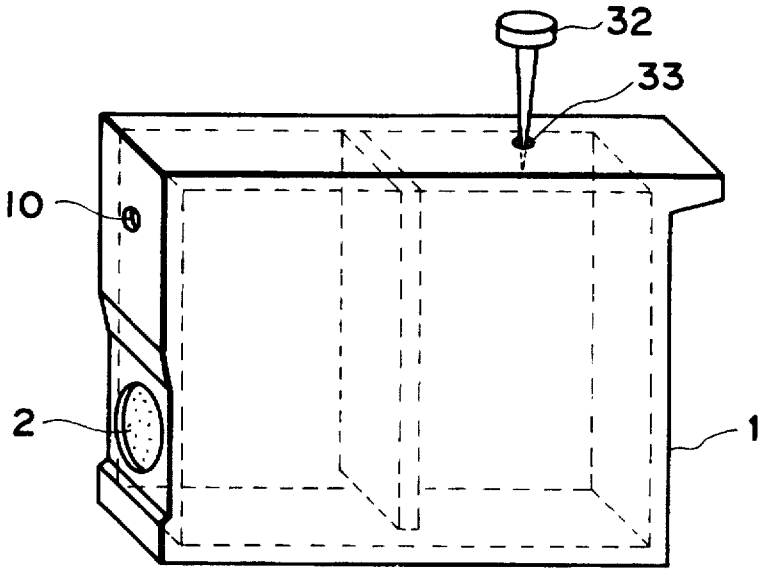
FIG. 21 is a sectional view, illustrating an opening for ink refilling.
Figure 22A:
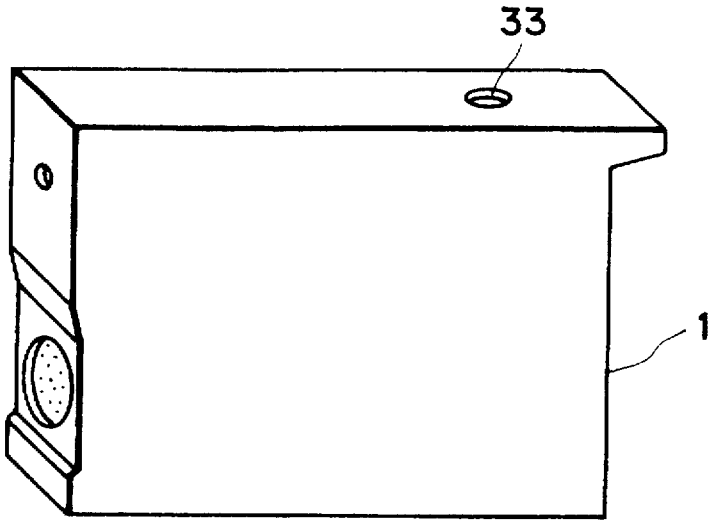
FIGS. 22A and 22B are sectional views, illustrating an ink refilling opening according to an embodiment of the present invention.
Figure 22B:
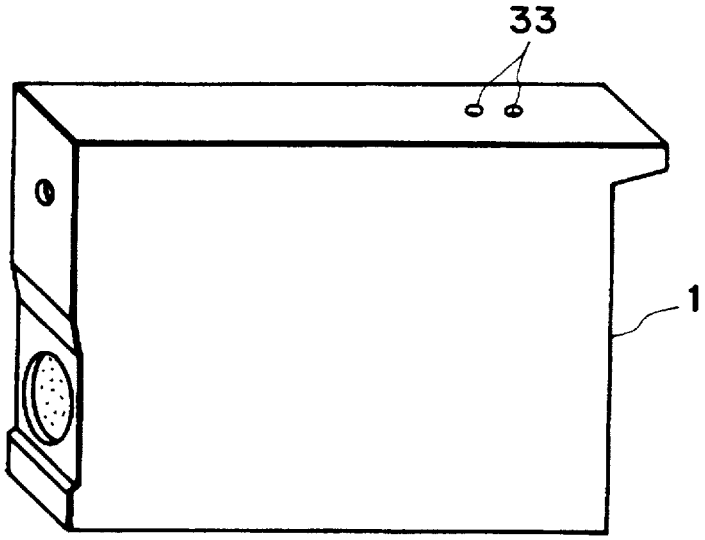

Referring to FIG. 20, there is shown an example of means doing this. In FIG. 20, there are shown an ink cartridge having a second chamber from which the ink is used up, an ink refilling container 30 containing refilling ink 21 and comprising an ink injection nozzle and bellows, and a tool 32 for forming an ink refilling port 33. The ink refilling port is formed in the second chamber, as shown in FIG. 21. The refilling port is formed using the tool 32 in the form of a pin, a drill or the like, as shown in FIGS. 22A and 22B. In FIG. 22A, the opening 33 is larger than an outer diameter of the ink injection nozzle. In FIG. 22, two openings 33 each having a diameter equivalent to or slightly smaller than the outer diameter of the ink injection nozzle, the one being for injection and the other as an air vent. In either example, the ink can be filled in the second chamber in good order, in the ink refilling operation.

By the use of the ink filling method described above, the ink accommodating portion can be filled with the ink. In this method, it is preferable that after the gap is filled with the ink, the air in the ink accommodating portion is discharged through the ink refilling port. In addition, it is also preferable that the ink filling is not limited in the ink containing portion, but extends into the negative pressure producing material accommodating portion, while forming an air-liquid interface, so as to connect the gap and the ink supply port.

Then, the ink is injected both into the ink accommodating portion and the material accommodating portion. In order to permit expansion of the ink in the negative pressure producing material, a certain period is required as contrasted to the ink injection into the ink containing portion.

If the ink injection speed is too high, the ink may overflow through the ink refilling port, and therefore, the ink injection speed is determined in consideration of the ink diffusion in the negative pressure producing material. Therefore, the ink filling speed can not be so high.

In the case that the ink overflows through the ink refilling port, the ink is not sufficiently loaded between the ink supply port and the gap, frequently. If this occurs, an ink path is possibly not continues between the ink accommodating portion and the recording head in the material accommodating chamber when the ink cartridge is coupled with the recording head.

A further embodiment will be described, in which the above problem is solved. This embodiment is applicable to an ink cartridge having an ink injection port 7 shown in FIG. 1 or the like. This method can be used for an initial ink filling in a fresh ink cartridge. In the case of refilling, the sealing member for sealing the ink injection port is removed, by which the refilling is enabled.

Figure 23A:
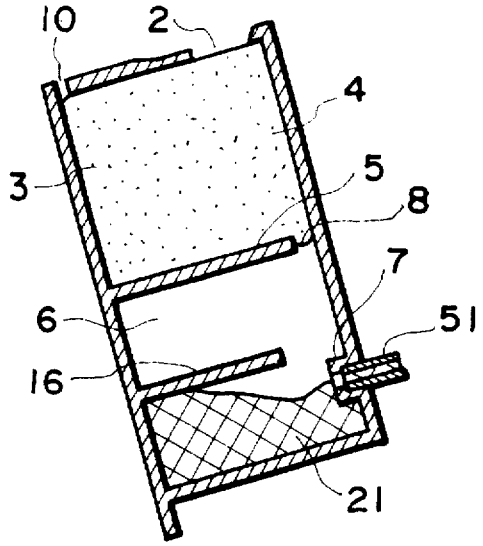
FIG. 23A illustrates an initial stage of an ink injection, according to a further embodiment of the present invention.

As shown in FIG. 23A, in the ink injection in this embodiment, when the ink is injected, the ink containing portion 6 takes the bottom position in the manner that the communication gap 8 with the material accommodating portion 4 takes the top position in the ink containing portion 6.

FIG. 23A shows an initial stage after the start of the ink 21 injection, which is started after an ink supply member 51 of an unshown ink injector (not shown) is inserted through an ink injection port 7 of the ink cartridge.

An outer peripheral portion of an end of the ink supply member 51 is of elastic material, and is contacted to the ink injection port 26 to seal it. Because the ink cartridge is inclined such that the gap 8 takes the topmost position, the air in the ink containing portion 6 is easily moved into the material accommodating portion 4 along the partition wall 5 and the partition plate 16, when the ink is injected.

When the inside air can be easily moved, the ink cartridge is not necessarily inclined, but may be placed with the topmost surface of the ink accommodating portion at the same level as the gap, while the ink is injected.

Figure 23B:
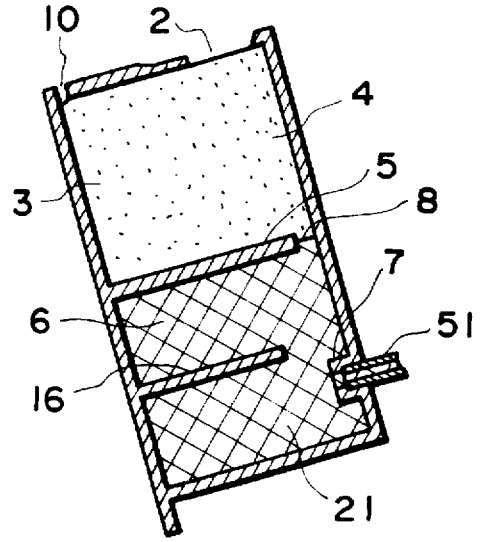
FIG. 23B is a similar view but after completion of ink container filling.
Figure 23C:
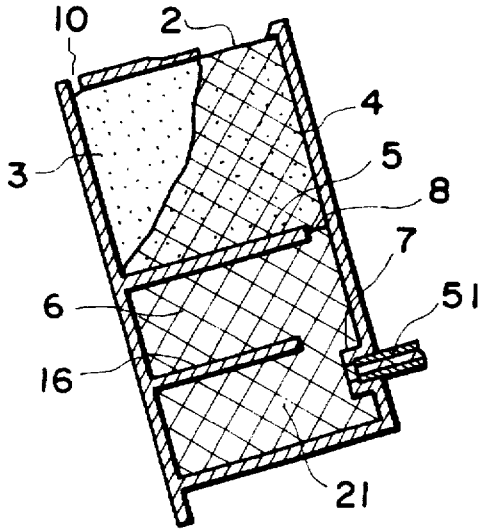
FIG. 23C is a similar view but when the ink filling is completed.
Figure 24A:
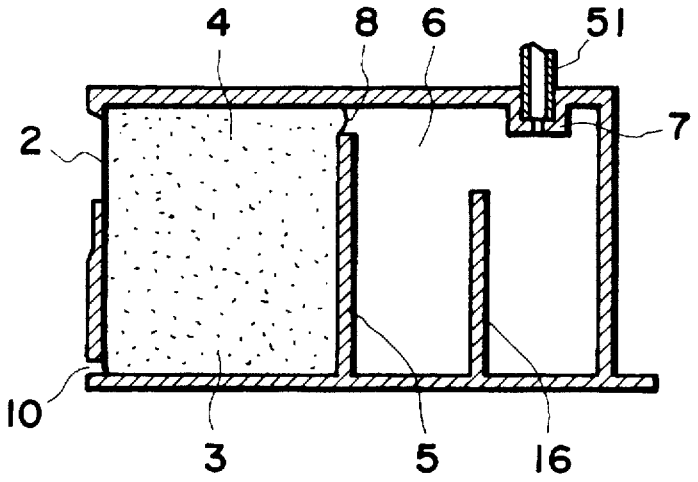
FIGS. 24A and 24B illustrate positions of an ink cartridge during ink injection, according to a further embodiment of the present invention.
Figure 24B:
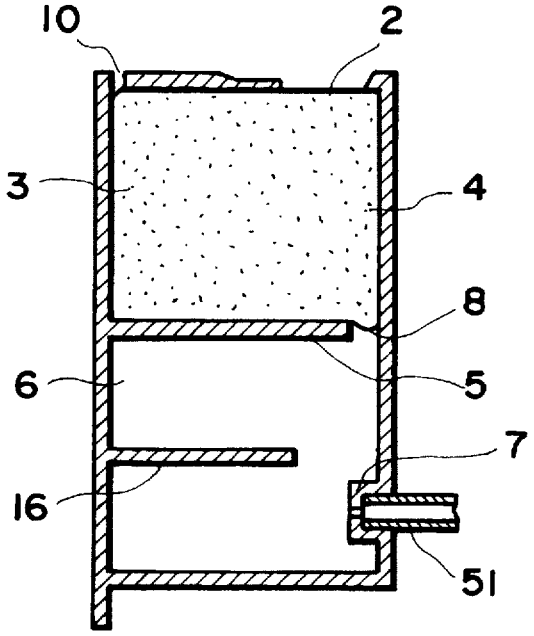

By injecting the ink in the above-described manner, the ink injection can be performed without the air in the form of bubbles remaining in the ink accommodating portion, at the point of time when the ink is injected into the ink accommodating portion 6 is completed, as shown in FIG. 23B. By continuing the ink injection, the ink can be supplied into the material accommodating portion 4, as shown in FIG. 23C. By this injection, the presence of the air bubbles in the ink accommodating portion can be prevented, and in addition, the presence of the ink in the communication path between the gap 8 and the opening 2 in the negative pressure producing material accommodating portion 4. Therefore, the stability of the ink supply to the recording head is assured.

When the partition wall 5 is provided with the air introducing groove, an ink meniscus is formed in the groove, so that the flow of the ink from the gap along the air introducing groove can be suppressed by a certain degree. The suppressing effect promoted by the adjusting chamber which is effective to ease the compression of the porous material. By this, the ink dispersion to the neighborhood of the air vent is prevented so that the ink leakage after the ink filling can be prevented.

The description will be made as to the configuration around the ink injection port 7.

Figure 26:
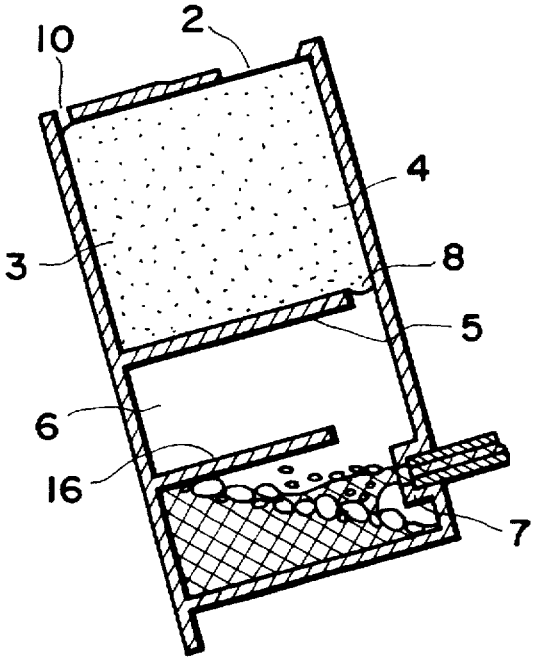
FIG. 26 illustrates production of bubbles in ink injection step.

In this embodiment, a relationship between a diameter of an ink injection tube and an ink injecting speed is taken into account. The investigations have been made t o increase the productivity in the ink injection. The results are as follows. If the inside diameter of the ink supply tube 51 is less than 1 mm, foaming occurs as shown in FIG. 26 when the ink supply rate is increased in an attempt to increase the throughput. Particularly when the inside diameter is approx. 0.5 mm, the foaming is so significant that the bubbles are not extinguished even if the communicating gap takes the topmost position during the ink injection. Therefore, a significant amount of air bubbles remains in the ink accommodating portion. If the inside diameter is not less than 1 mm, the foaming does not occur so that the ink can be injected stably at a rate of approx. 2 cc/sec.

As regards the diameter of the ink injection port 7, it is preferable that it is equivalent to that of the ink supply port 51 or larger. In consideration of a safe factor against the foaming, the inside diameter of the ink supply tube 51 is 1.5 mm, and the diameter of the ink injection port 7 is 2.5 mm taking into account the positional accuracy of the ink supply tube 21 and the manufacturing accuracy. By doing so, the preferable results are provided.

In another ink cartridge having the structure, the ink injection is carried out through the same injection method, and it has been confirmed that the ink injection is possible without air bubbles in the ink containing portion, when the communication gap takes the topmost position.

Figure 25A:
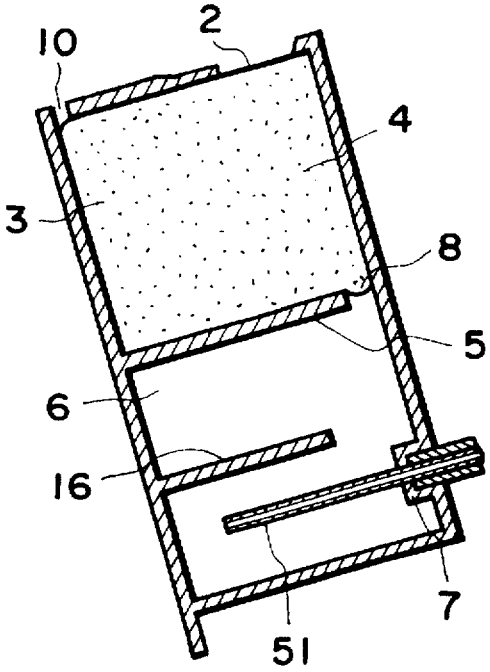
FIGS. 25A and 25B illustrate an ink filling apparatus, according to a further embodiment of the present invention.
Figure 25B:
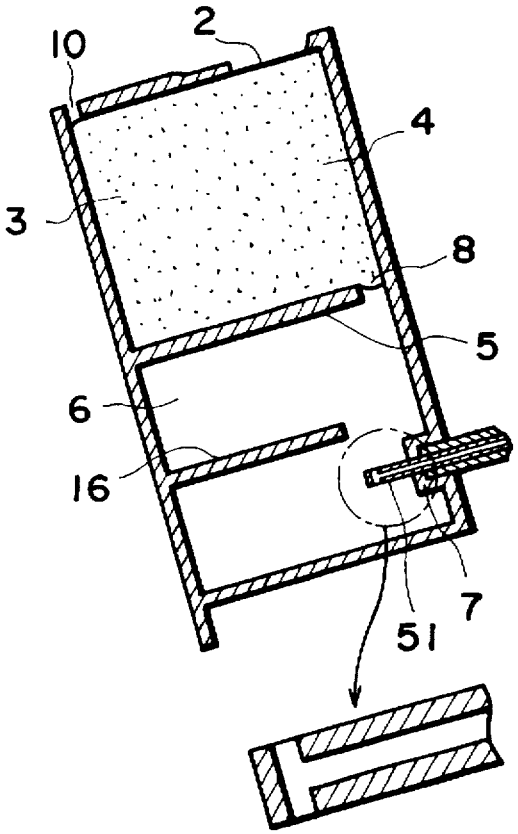

However, in the case of an ink cartridge having a large capacity, the productivity is not enough with the injection speed of 2 cc/sec. In order to increase the injection speed, a high speed injection nozzle shown in FIGS. 25A and 25B is usable. As shown in FIG. 25B, the ink supply tube end has a particular configuration.

As shown in FIG. 25A, the nozzle is so long that it can reach to the bottom of the ink accommodating portion 6 taking the injection position or pose. FIG. 25B shows a modified nozzle in which the tip end of the nozzle is not open, but the flow path is branched to the opposite sides. In either case, the inside diameter of the ink supply tube 51 is not less than 1 mm, preferably not less than 1.5 mm. The end portion is inserted through the ink injection port 7 into the ink accommodating portion 6, and during the ink injection, the ink flows along the surrounding walls, so that the foaming is prevented, while permitting high speed injection.

When the nozzle shown in FIG. 25 is used, the ink can be injected at the maximum speed of 4 cc/sec, without the foaming.

The description will be made as to after the initial stage of the ink injection.

FIG. 23B illustrates the state in which the ink accommodating portion 6 is filled with the ink. In FIG. 23C, the further ink injection has been continued, and the ink 9 is supplied into the negative pressure producing material 3, and therefore, the ink injection is completed. The ink in the material 3 flows through the communication gap 8, and a part of the ink flows through the gap between the wall 5 and the material 3. However, most of the ink flows toward the opening 2 in communication with the ink jet recording head, because the air in the material 3 moves in this direction. In order to promote this ink flow, the ink cartridge may be preferably provided with an air introducing groove and an adjusting portion.

According to the above-described method, the ink can be easily supplied out when the ink cartridge is coupled with an ink jet recording head, and therefore, the ink supply efficiency is high. In addition, the ink is not supplied to the neighborhood of the air vent 10, and therefore, the leakage of the ink through the air vent 10 can be prevented.

The ink is supplied with a predetermined pressure from a supplying apparatus, and is stopped after a predetermined amount of the ink is supplied.

After the completion of the injection, the opening 2 and the air vent 10 are closed without delay, as described hereinbefore. Thereafter, the ink supply tube 15 is removed from the ink injection port 7, and the ink injection port 7 is plugged with a plastic or metal spherical plug 17.

In the foregoing embodiment, the use is made with an ink injection apparatus capable of adjusting the ink injection speed. In the next embodiment, the ink is filled into the ink cartridge with simpler structure.

Figure 27:
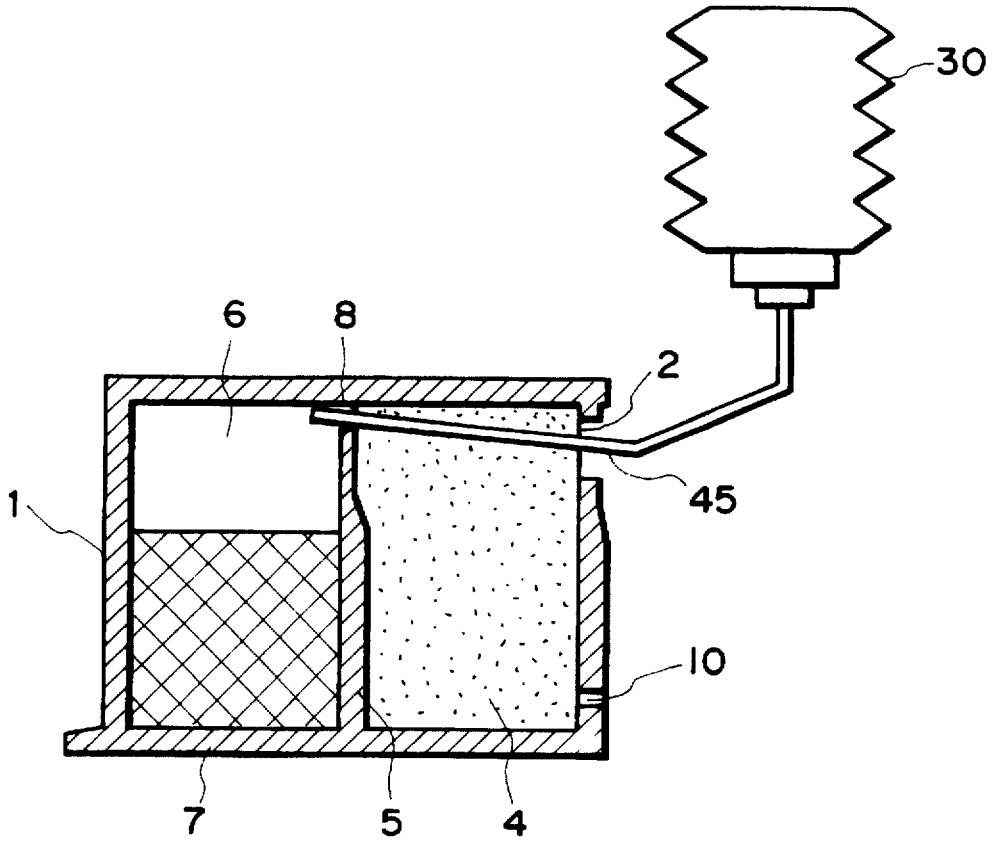
FIG. 27 illustrates an ink filling apparatus, according to a further embodiment of the present invention.

Similarly to the foregoing embodiment, the ink cartridge used up or partly used from the ink accommodating portion 6 is placed so that the gap 8 takes the topmost position. Then, an ink supply tube 15 is inserted through the opening 2 and through the negative pressure producing material 3 and through the gap into the ink accommodating position, in this embodiment as shown in FIG. 27. Using an ink refilling container 30, the ink is directly injected into the ink accommodating portion 6. The ink refilling container 30 is provided with a pumping function to force the ink into the ink accommodating portion 6. In FIG. 27 example, the container has bellows to permit pressure injection.

The air in the ink accommodating portion 6 is discharged to the outside corresponding to the injection of the ink.

Figure 28:
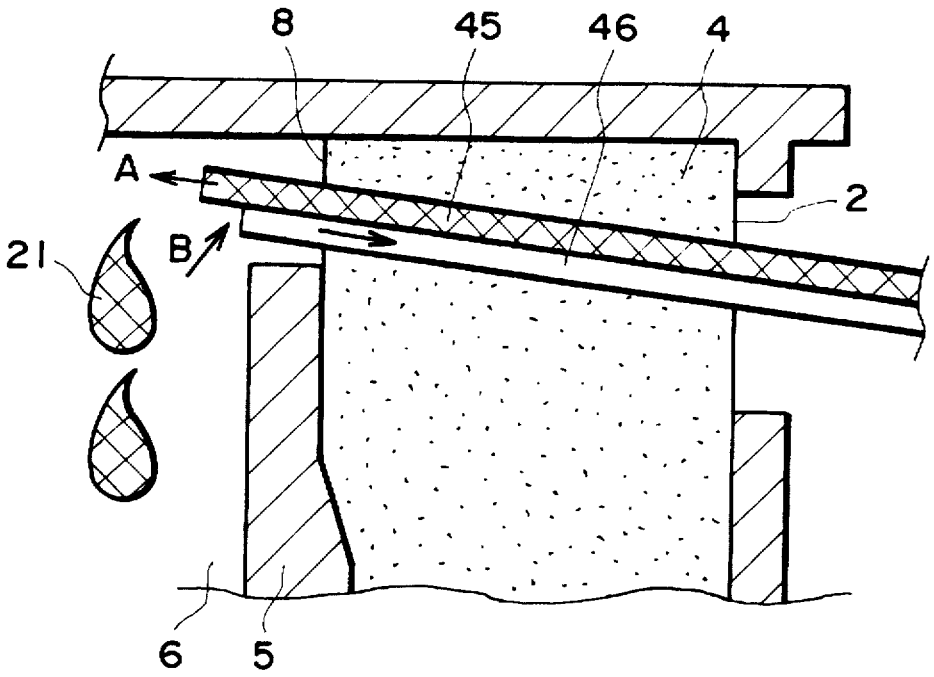
FIG. 28 illustrates an ink filling apparatus, according to a further embodiment of the present invention.

Normally, the air is discharged through the air vent 10 through the negative pressure producing material 4 through the gap 8 along the path of the ink flow when the ink is used for the recording, but in the opposite direction. If the material 4 contains a great amount of the ink, the discharge of the air from the ink accommodating portion 6 is not smooth. Therefore, as shown in FIG. 28, an air discharging tube 46 is also inserted into the negative pressure generating material 4 together with the ink supply tube 45, to permit the smooth air discharge. An arrow A in FIG. 28 indicates the ink injection direction, and an arrow B is an air discharging direction.

Figure 29:
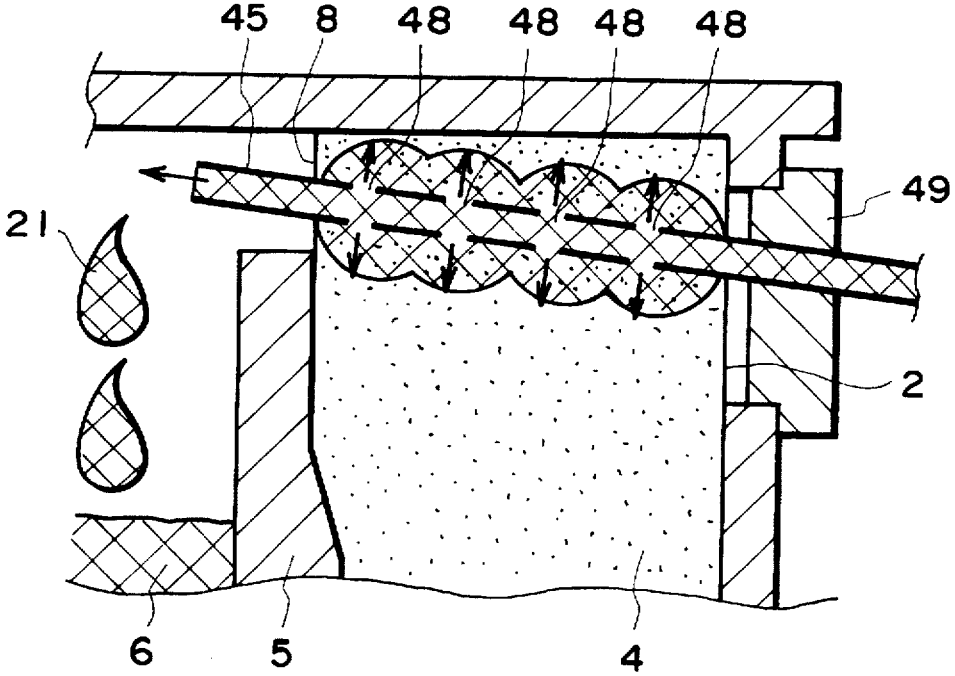
FIG. 29 illustrates an ink filling apparatus according to a further embodiment of the present invention.

On the contrary, when most of the ink in the material 4 is used up, the air is filled between the opening 2 and the gap 8, even if the ink is sufficiently supplied into the ink accommodating portion 6. Then, even if the ink is sucked from the opening 2, the ink is not sucked from the ink accommodating portion 6. In such a case, the ink is preferably filled between the opening 2 and the gap 8. For this purpose, at least one fine holes 48 are formed at the middle portion of the ink supply tube 45, as shown in FIG. 29, by which the ink can be filled between the opening 2 and the gap 8 in the negative pressure producing material 4, during the ink filling process. In addition, to prevent ink leakage adjacent the opening 2, the opening 2 is plugged with a gap 49, during the ink refilling operation.

By a combination of the exhausting tube 46, fine holes 48 or the cap 49, is possible in any way to permit simple and easy ink filling operation.

As shown in FIG. 27, the ink supply tube is in the form of a needle, and therefore, when the quantity of the ink is small in the material 4, the ink may be injected into the material after the ink accommodating portion is filled with the ink, by which the formation of the ink flow path between the gap 8 and the opening 2 is easily assured. When the ink is injected beyond the capacity of the ink accommodating portion, the ink flows between the internal wall surface of the ink cartridge and the material 4, as described hereinbefore. Similarly to this, because of the wettability of the needle, the ink is easily expanded between the needle and the material 4.

Figure 30A:
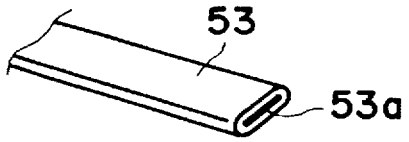
FIGS. 30A, 30B and 30C illustrate an example of an ink filling apparatus according to a further embodiment of the present invention.

Referring to FIG. 30A, a further embodiment will be described in which the ink injection needle 53 has a flat cross-section. The ink injection needle, as shown in FIG. 30B, is inserted between the internal wall surface of the material accommodating portion 4 and the material 3 to project the flat end into the ink accommodating portion 6, and the ink is injected into the accommodating portion 6 from the ink injection port 53.

Figure 30B:
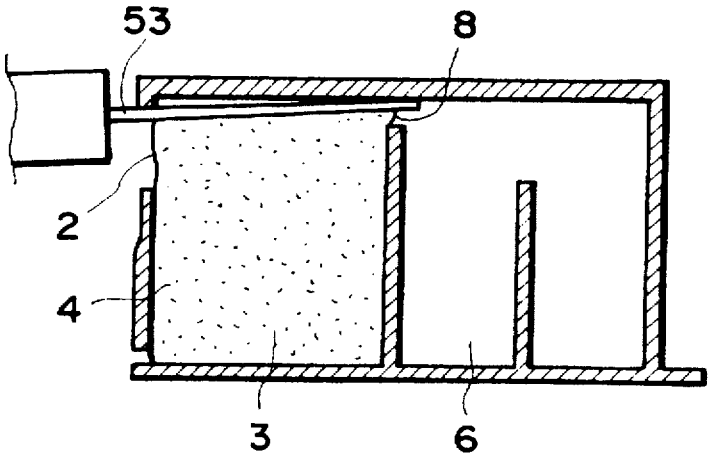
Figure 30C:
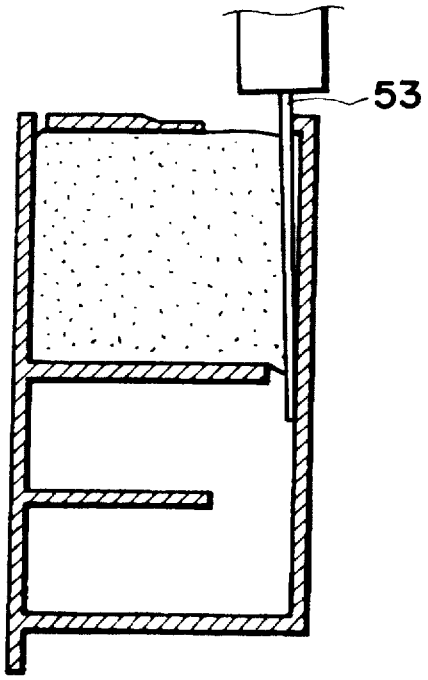

FIGS. 30B and 30C show the position of the ink cartridge and the ink injection needle 53 during the ink injection. As a result, similarly to the foregoing embodiments, the ink can be supplied into the ink accommodating portion 6 and to between the gap 8 and the opening 2.

With the following structure, the injection needle 53 can be smoothly and easily inserted. It is preferable that the structures of FIGS. 28 and 29 are used in this embodiment to improve the ink filling speed and to assure the formation of the ink path in the negative pressure producing material accommodating portion.

Figure 31A:
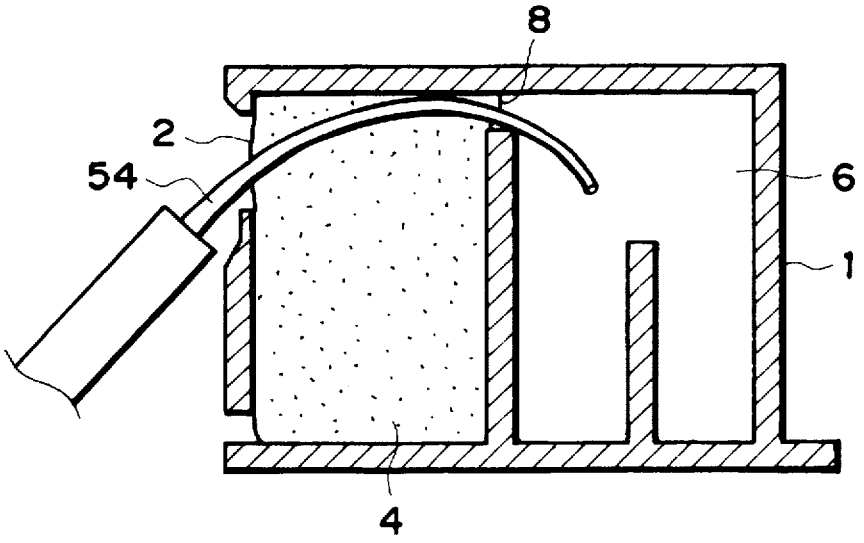
FIGS. 31A and 31B illustrate an ink filling apparatus according to a further embodiment of the present invention.
Figure 31B:
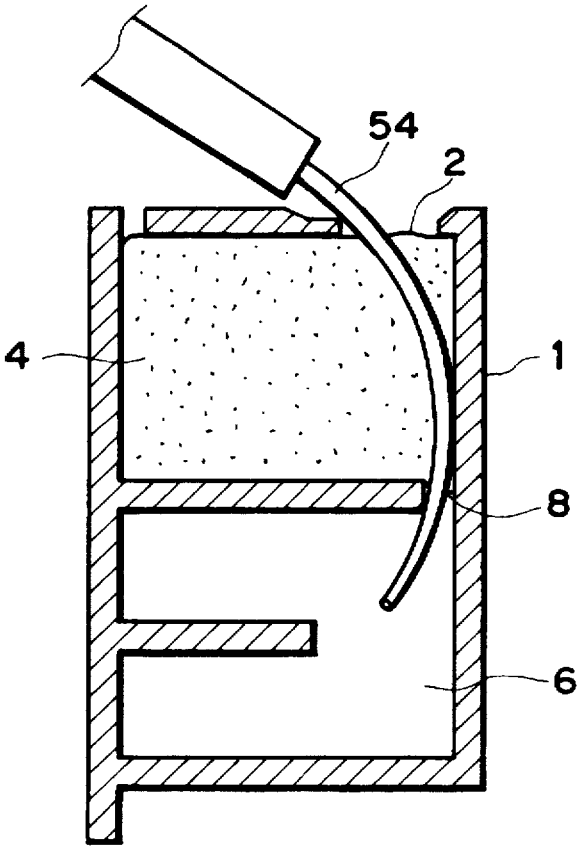

In the foregoing embodiments, the ink injection needle 45 and 53 have a straight configuration. In the following embodiment, the ink injection needle 54 is curved as shown in FIGS. 31A and 31B.

The curved ink injection needle 54 can be inserted in the manner that the end thereof is positioned about the center of the ink accommodating portion 6. The curvature and the length of the needle 54 may be determined in consideration of the configuration and the size of the ink cartridge 1, so that the end of the ink injection needle 54 can be easily placed at a desired position. For example, the end of the injection needle 54 may be placed below the ink level, thus reducing the foaming of the ink, during the pressurized ink injection.

Figure 32A:
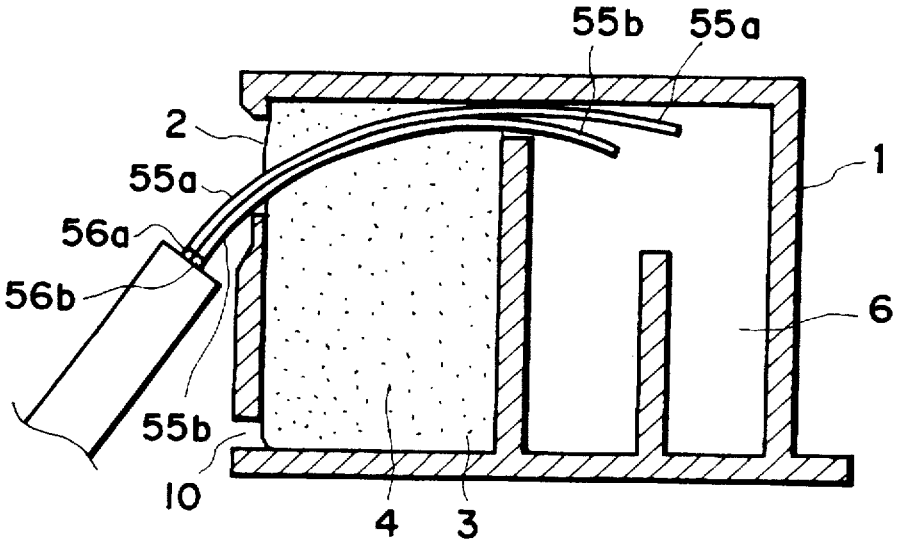
FIGS. 32A and 32B illustrate an ink filling apparatus according to a further embodiment of the present invention.
Figure 32B:
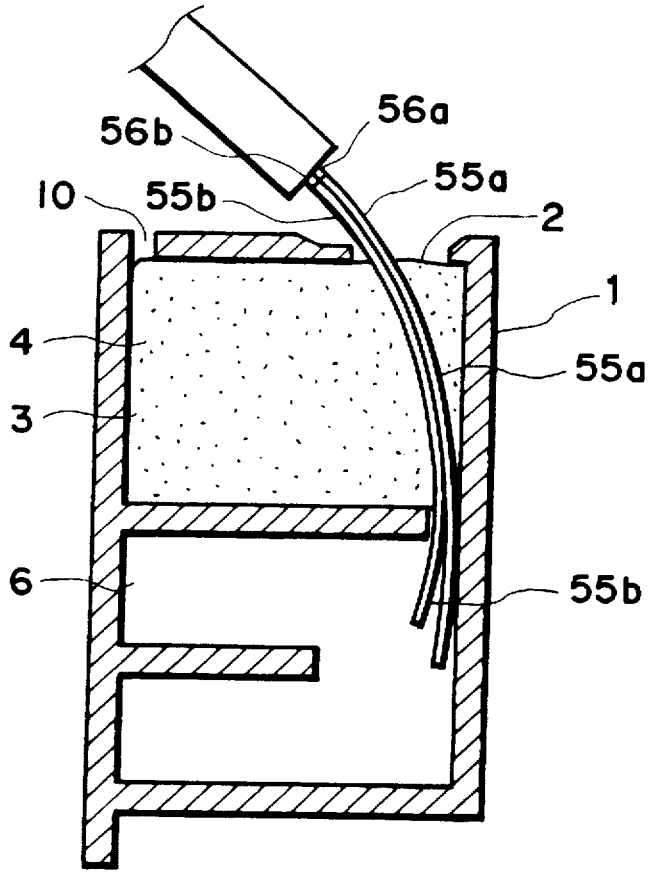

FIGS. 32A and 32B illustrate a further embodiment, wherein a plurality of ink injection needles can be inserted to supply the ink at a plurality of positions. In this embodiment, the ink injection speed can be decreased, thus avoiding the foaming of the ink. In addition, the ink can be more uniformly injected, so that the ink can be injected more effectively.

According to the embodiments of FIGS. 32A and 32B, the ink injection needles 55*a* and 55*b* have different radius of curvature. The ink injection needles 55*a* and 55*b* are separately inserted into the same ink cartridge, and after the end of the ink injection needle is reached in the ink accommodating portion, the ink injection needles 55*a* and 55*b* are mounted to joints 55*a* and 55*b* of the common ink injection device. Then, the ink is injected through both of the injection needles.

Figure 33A:
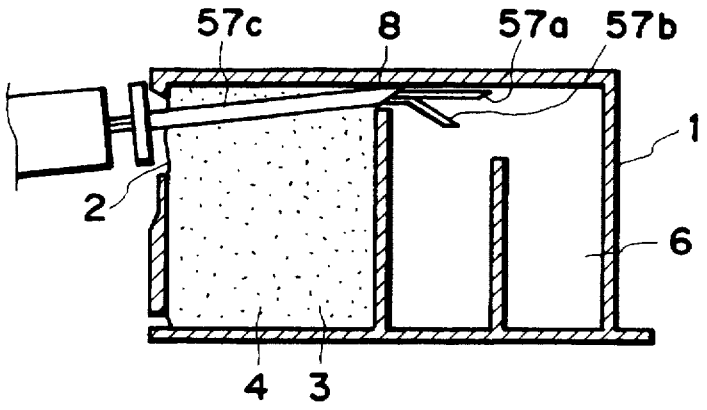
FIGS. 33A, 33B and 33C illustrate an ink filling apparatus according to a further embodiment of the present invention.
Figure 33B:
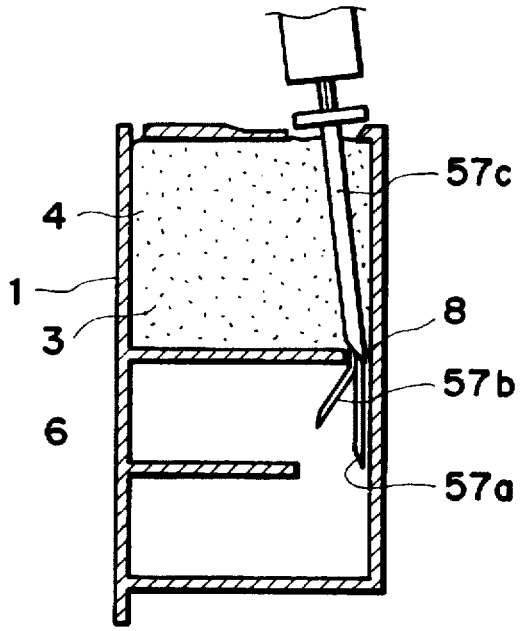

FIG. 33 shows a further embodiment, in which one 57*a* of the ink injection needles is straight, and the other 57*b* has a bent portion.

The ink injection needle 57*b* is elastically deformable into a straight configuration. There is provided an adapter 57*c* having an obliquely cut end. Through the adapter 57*c*, the ink injection needles 57*b* and 57*a* can be inserted. The two needles 57*a* and 57*b* are slidable in the adapter 57*c*.

Figure 33C:
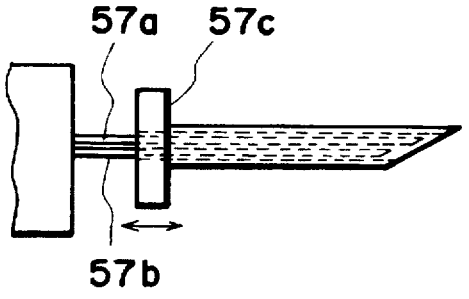

First, the adapter 57*c* is inserted into the negative pressure producing material 3 without the ink injection needles 57*a* and 57*b* projected out, as shown in FIG. 33C. Then, after the end of the adapter 57*c* reaches the bottom communication gap 8, the ends of the injection needles 57*a* and 57*b* are projected out. Then, the ink injection needle 57*b* restores the bent configuration, so that the ink outlet ends of the needles are separated from each other.

By the separation, the ink can be distributed uniformly in the ink accommodating portion 6, and the foaming can be prevented. Therefore, upon the reinjection, the ink can be smoothly supplied.

Figure 34A:
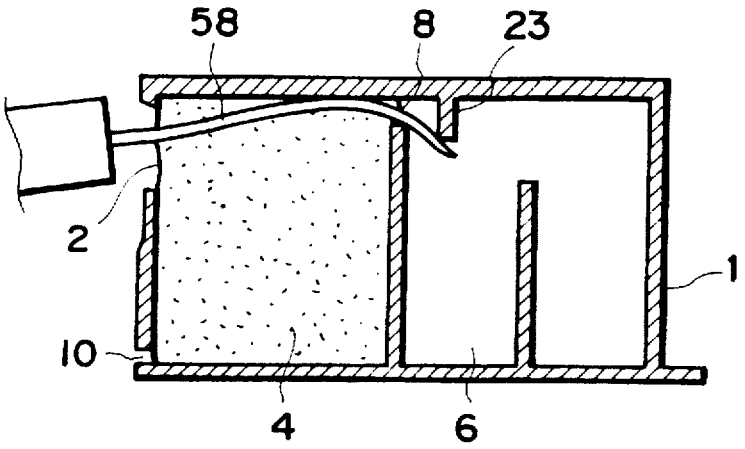
FIGS. 34A and 34B illustrates an ink filling method and apparatus usable with an ink cartridge having a further structure, to which the present invention is applicable.
Figure 34B:
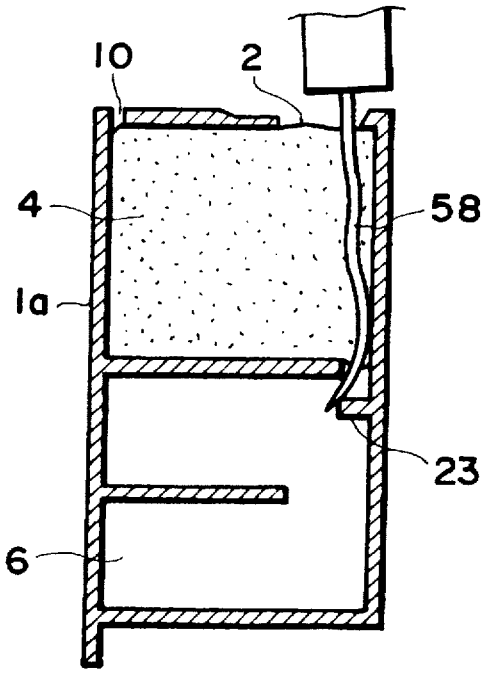

Referring to FIGS. 34A and 34B, a further embodiment will be described. In these Figures, the ink is being injected.

According to this embodiment, the ink can be injected in the similar manner as in the foregoing embodiments, for an ink cartridge la having a projection plate 23 on a bottom of the ink accommodating portion 6.

The projection 23 has an ink leakage preventing function. For example, the ink cartridge having the ink accommodating portion 6 containing one half ink, is kept under 60° C. condition for example with the position shown in FIG. 34A, the ink evaporates with the result that the ink moves from the ink accommodating portion 6 into the material accommodating portion 4 if the projection plate 23 is not provided. If the material accommodating portion 4 is filled with the ink, the ink starts to leak through the air vent 10. By the provision of the plate 23, the evaporated ink is deposited on the surface of the projection plate 23 in the form of dew droplets. The droplets deposited adjacent the gap are gradually sucked through the gap 8 by the material 4 by the capillary force. However, because the ink is in the form of droplets, the movement of the ink can be prevented.

In this case, the ink injection needle having the configuration described hereinbefore, is not easily inserted into the ink accommodating portion 6. In this embodiment, the material of the ink injection needle 58, particularly the end portion thereof, has high elasticity, so that it can be inserted around the projection plate 23, as shown in FIGS. 34A and 34B, so that the ink can be properly supplied.

As described hereinbefore, according to an aspect of the present invention, the ink can be easily supplied into the ink cartridge, and therefore, the ink cartridge can be reused. This reduces the running cost and extend the service life of the ink cartridge body. There is no need of dispose of the used ink container body to avoid the environmental problems.

According to another aspect of the present invention, the ink is injected while the communicating gap takes the topmost position in the ink accommodating portion. Therefore, the ink can be injected while pushing the air out, so that the ink can be properly supplied to a desired position without foaming of the ink. Thus, the use efficiency is high. In addition, the ink leakage through the air vent can be prevented.

According to a further aspect of the present invention, the ink refilling is effected from an ink containing portion, and the ink refilling port is sealed by a separate member. By doing so, the ink cartridge can be reused while maintaining the function of a fresh ink cartridge, by which the running cost can be reduced, and the resources can be saved.

According to a further aspect of the present invention, easy and simple ink refilling means can be provided.

According to a further aspect of the present invention, the negative pressure is provided with stability, and the ink can be filled into a cartridge having a large ink accommodating capacity per unit volume. A high quality printing is possible with high performance of the ink cartridge even if it is repeatedly reused.

The inventors have investigated the property of the ink suitably usable with the ink containers of the foregoing embodiments. The preferable ink shows the stability of the air-liquid exchange portion against the vibration of the ink, and it is stabilized against the ambient condition change.

The description will be made such inks suitably usable with the ink containers of the foregoing embodiments.

The fundamental structure of the ink includes at least water, coloring material and water-soluble organic solvent. The organic solvent is low volatile and low viscosity material having high compatibility with water. The following is examples: amides such as dimethylformamide and dimethylacetoamide, ketones such as acetone, ethers such as tetrahydrofuran and dioxane, polyalkylene glycols such as polyethylene glycol and polypropylene glycol, alkylene glycols such as ethylene glycol, propylene glycol, butylene glycol, triethylene glycol, thiodiglycol, hexylene glycol and diethylene glycol, lower alkyl ethers of polyhydric alcohols such as ethylene glycol methyl ether, diethylene glycol monomethyl ether and triethylene glycol monomethyl ether, monohydric alcohols such as ethanol and isopropyl alcohol, and besides, glycerol, 1,2,6-hexanetriol, N-methyl-2-pyrrolidone, 1,3-dimethyl-2-imidazolidinone, triethanolamine, sulfolane and dimethyl sulfoxide. No particular limitation is imposed on the content of the water-soluble organic solvent. However, it may preferably be within a range of from 1 to 80% by weight. The coloring material usable with this invention may be a dye or a pigment. The dye may preferably be water-soluble acid dye, direct color, basic dye, reactive dye or the like. The content of the dye is not particularly limited, but 0.1–20% by weight on the basis of the ink total weight is preferable.

Use of surfactant is desirable to adjust the surface tension. Examples of such a surfactant used include anionic surfactants such as fatty acid salts, higher alcohol sulfuric ester salts, alkylbenzene-sulfonates and higher alcohol phosphoric ester salts, cationic surfactants such as aliphatic amine salts and quaternary ammonium salts, nonionic surfactants such as ethylene oxide adducts of higher alcohols, ethylene oxide adducts of alkylphenols, aliphatic ethylene oxide adducts, ethylene oxide adducts of higher alcohol fatty acid esters, ethylene oxide adducts of higher alkyl amines, ethylene oxide adducts of fatty acid amides, ethylene oxide adducts of polypropylene glycol, higher alcohol fatty acid esters of polyhydric alcohols and alkanolamine fatty acid amides, and amino acid- and betaine-type amphoteric surfactants. No particular limitation is imposed on such a surfactant. However, nonionic surfactants such as ethylene oxide adducts of higher alcohols, ethylene oxide adducts of alkylphenols, ethylene oxide-propylene oxide copolymers, ethylene oxide adducts of acetylene glycol are preferably used. Further, it is particularly preferred that the number of moles of added ethylene oxide in the ethylene oxide adducts should be within a range of from 4 to 20. No particular limitation is imposed on the amount of the surfactant to be added. However, it may preferably be within a range of from 0.01 to 10% by weight. The surface tension may be controlled by the above-described water-soluble organic solvent.

In addition to the above components, the first liquid may contain additives such as viscosity modifiers, pH adjusters, mildewproofing agents or antioxidants, as needed.

The viscosity of the ink is 1–20 cp. The surface tension should be 20 dyne/cm–55 dyne/cm. Further preferably, it is 25–50 dyne/cm. If the surface tension of the ink is within this range, it does not occur that the meniscus of the recording head orifice is broken and but the ink is leaked out from the head orifice when the printing operation is not carried out.

The quantity of the ink contained in the ink cartridge may be properly determined up to the limit of its inside volume. In order to maintain the vacuum immediately after the ink cartridge is unpacked, the ink may be filled to its limits. However, the quantity of the ink in the vacuum producing material may be lower than the ink retaining capacity of the vacuum producing material. Here, the ink retaining capacity is the amount of the ink capable of being retained in the individual material.

The inks according to the embodiments of the present invention and the comparison example will be described.

A mixture of water and water-soluble organic solvent is stirred with a dye for four hours, and thereafter, a surfactant is added thereto. Then, it is passed through a filter to remove foreign matters.

The following is composition, nature of the ink and the result of record.

| | Ex. 1 | Ex. 2 | Ex. 3 | Ex. 4 |
|---|---|---|---|---|
| diethylene glycol | 15% | 10% | 10% | 10% |
| cyclohexanol | | | | 2% |
| glycerol | | 5% | | |
| thiodiglycol | | | 5% | 5% |
| SURFRON S-145 (fluorinated surfactant) | | 0.1% | | |
| ACETYLENOL EH (acethylene glycol-ethylene oxide adducts) | 2% | | | |
| dyestuff | 2.5% | 2.5% | 0.2% | 2.5% |
| water | rest | rest | rest | rest |

-continued

| | Ex. 1 | Ex. 2 | Ex. 3 | Ex. 4 |
|---|---|---|---|---|
| [surface tension] | [31 dyne/cm] | [25 dyne/cm] | [40 dyne/cm] | [40 dyne/cm] |

Clear color images have been recorded, and the ink in the cartridge has been used up without trouble, for all of Examples 1–4.

| | Comp. Ex. 1 | Comp. Ex. 2 |
|---|---|---|
| diethylene glycol | 15% | |
| glycerol | | 5% |
| thiodiglycol | | 5% |
| SURFLON S-145 (fluorinated surfactant) | 0.1% | |
| ACETYLENOL EH (acethylene glycol-ethylene oxide adducts) | | |
| dyestuff | 2.5 | 2.5% |
| water | rest | rest |
| [surface tension] | 17.6 dyne/cm Clear color images has been formed. The ink has dropped out from the head by small input. | 57.4 dyne/cm Bleeding has occurred between colors. The ink has dropped out from the head by small impact. |

The yellow dye was Acid Yellow 23, the cyan dye was Acid Blue 9, the magenta dye was Acid Red 289, and the black dye was Direct Black 168.

The surface tension was measured at 25° C. through Wilhelmy method.

The following is the surface potential at 20°–25° C. of typical water-soluble organic solvents:

Ethanol (22 dyne/cm), isopropanol (22 dyne/cm), cyclohexanol (34 dyne/cm), glycerin (63 dyne/cm), diethyleneglycol (49 dyne/cm), diethyleneglycol monomethylether (35 dyne/cm), triethyleneglycol (35 dyne/cm), 2-pyrrolidone (47 dyne/cm), N-methylpyrrolidone (41 dyne/cm).

The desirable surface tension can be provided by mixture with water.

The method of controlling the ink surface tension using surfactant will be described.

For example, 28 dyne/cm of the surface tension can be provided by addition of 1% of sorbitan monolaurate ester on the basis of water; 35 dyne/cm can be provided by addition of 1% of polyoxyethylene-sorbitan monolaurate ester; 28 dyne/cm can be provided by addition of not less than 1% of ACETYLENOL EH (acetylene glycol-ethylene oxide adducts). If a lower surface tension is desired, 17 dyne/cm is provided by addition of 0.1% of SURFLONS-145 (perfluoroalkyl-ethylene oxide adducts) (available from Asahi Glass Kabushiki Kaisha, Japan). The surface tension slightly varies by another additives, and therefore, proper adjustment can be done by skilled in the art.

As described in the foregoing, the ink buffer is designed in consideration of the maximum leaking ink quantity. It has been found that the ink buffering effect is significantly influenced by the composition of the ink.

The ink for the ink jet recording containing surfactant has been proposed. The ink is advantageous in that the fixing property is very good for a copy sheet, bond sheet or another plain paper, that in proper color mixing (bleed or the like) does not occur even when different color ink recording regions are close in the color recording, and therefore, uniform coloring is possible. The following is an example of the composition:

Ex. 5 dye 4 parts
glycerol 7.5 parts
thiodiglycol 7.5 parts
acetylene glycol-ethyl oxide adducts (m+n=10) 5 parts
urea 7.5 parts
pure water 68.5 parts When such an ink used, the ink does not leak out of the ink cartridge because the ink is absorbed by the absorbing material 3 in the ink chamber 4 when the ink is pushed out of the ink chamber 6 into the ink chamber 4 due to the expansion of the air in the ink chamber 6 due to the temperature rise or the pressure reduction in the atmosphere. In an example of this embodiment, the total height in the ink chamber is 3 cm, the ink chamber 4 and the ink chamber 6 have the volume of 6 cc, respectively. At the time of the initial stage, the ink chamber 6 is completely filled (6 cc), and the ink chamber 4 containing the compressed absorbing material 3 (polyurethane foamed material) contains 4 cc ink (ink total: 10 cc). The porosity of the absorbing material is not less than 95%, and if it is assumed that the ink is completely contained in the all of the pores of the absorbing material, the ink chamber 4 is capable of containing approx. 6 cc.

In the case of Example 5 ink, the surface tension is small (30 dyne/cm$^2$) because of the addition of the surfactant, but the wettability between the absorbing material and the ink is improved. By doing so, it is more effective to improve the wettability of the ink latter than increasing the surface tension in order to improve the permeability.

The preferable penetrating agents include anion surfactant such as OT type aerosol, sodium dodecylbenzenesulfonate, sodium laurylsulfate, higher alcohol-ethylene oxide adducts represented by general Formula [1], alkylphenol-ethylene oxide adducts represented by general Formula [2], ethylene oxide-propylene oxide copolymer represented by general Formula [3] and acetylene glycol-ethylene oxide adducts represented by general Formula [4].

The anion surfactant has stronger foam producing tendency, and is poorer in the bleeding, color uniformity and feathering or the like than the nonionic surfactant, the following nonionic surfactant represented by the following formula is used.

Here, n is preferably 6–14, and R preferably has 5–26 carbon atoms, in Formula [1] and [2]; m+n is preferably 6–14 in Formulas [3] and [4].

$$R-O\leftarrow CH_2CH_2O\rightarrow_n H \quad [2]$$

where R is alkyl,

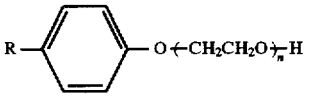

[2]

where R is alkyl, $$H\leftarrow CH_2CH_2O\rightarrow_m\leftarrow CH(CH_3)-CH_2O\rightarrow_n R \quad [3]$$

where R is hydrogen or alkyl,

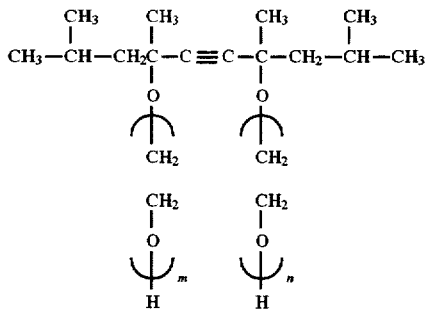

where m and n are respectively an integer.

Among the ethylene oxide nonionic surfactants, acetylene glycol-ethylene oxide adducts are preferable from the standpoint of absorption in the ink absorbing material, image quality on the recording material and ejection performance in total. The hydrophilic property and penetrating property can be controlled by changing number m+n of ethylene oxides to be added. If it is smaller than 6, the penetrating property is good, water solution nature is not good, and therefore, the solubility in water is not good. If it is too large, the hydrophilic property is too strong, and the penetrating property is too small. If it is larger than 14, the penetrating property is insufficient, and the ejection property is deteriorated. Therefore it is preferably 6–14.

The amount of the nonionic surfactant is preferably 0.1–20% by weight. If it is lower than 0.1%, the image quality and the penetrating property is not sufficient. If it is larger than 20%, no improvement is expected, and the cost increases, and the reliability decreases.

One or more of the above described surfactant are usable in combination.

The ink may contain dye, low volatile organic solvent such as polyhydric alcohols to prevent clogging, or organic solvent such as alcohols to improve bubble creation stability and fixing property on the recording material.

The water-soluble organic solvents constituting the ink of the embodiment may include polyalkylene glycols such as polyethylene glycol, and polypropylene glycol; alkylene glycols having 2 to 6 carbon atoms such as ethylene glycol, propylene glycol, butylene glycol, triethylene glycol, 1,2,6-hexanetriol, hexylene glycol, and diethylene glycol; glycerin; lower alkyl ether of polyhydric alcohols such as ethylene glycol methyl ether, diethylene glycol methyl (or ethyl) ether, and triethylene glycol monomethyl (or ethyl) ether; alcohols such as methyl alcohol, ethyl alcohol, n-propyl alcohol, isopropyl alcohol, n-butyl alcohol, sec-butyl alcohol, t-butyl alcohol, isobutyl alcohol, benzyl alcohol, and cyclohexanol; amides such as dimethylformamide, and dimethylacetamide; ketones and ketone alcohols such as acetone, and diacetone alcohol; ethers such as tetrahydrofuran, and dioxane; and nitrogen-containing cyclics such as N-methyl-2-pyrrolidone, 2-pyrrolidone, 1,3-dimethyl-2-imidazolidinone.

The water soluble organic solvent can be added without deteriorating the image quality or the ejection reliability. Preferably, it is polyhydric alcohols or alkyl ether of polyhydric alcohols. The content thereof is preferably 1–3% by weight. And, the pure water content is 50–90% by weight.

The dyes usable with the present invention include direct dyes, acid dyes, reactive dyes, dispersive dyes, vat dyes or the like. The content of the dye is determined depending on the kinds of the liquid components and the required properties of the ink, the ejection volume of the recording head or the like. Generally, however, it is 0.5–15% by weight, preferably 1–7% by weight.

By addition of the thioglycol or urea (or derivatives thereof) in the ink, the ejection property and the clog (solidification) preventing property is remarkably improved. This is considered to be because the solubility of the dye in the ink is improved. The content of the thioglycol or urea (or the derivatives thereof) is preferably 1–30%, and may be added as desired.

The main constituents of the ink of the present first invention are described above. Other additives may be incorporated provided that the objects of the invention are achievable. The additive includes viscosity-adjusting agents such as polyvinyl alcohol, celluloses, and water-soluble resins; pH-controlling agents such as diethanolamine, triethanolamine, and buffer solutions; fungicides and so forth. To the ink of electrically chargeable type used for ink-jet recording in which the ink droplets are charged, a resistivity-adjusting agent is added such as lithium chloride, ammonium chloride, and sodium chloride.

While the invention has been described with reference to the structures disclosed herein, it is not confined to the details set forth and this application is intended to cover such modifications or changes as may come within the purposes of the improvements or the scope of the following claims.

What is claimed is:

1. An ink filling method for filling an ink cartridge with ink to be supplied to a recording head for ejecting ink, the method comprising the steps of:

providing said ink cartridge having a negative pressure producing material accommodating portion and an ink accommodating portion, said negative pressure producing material accommodating portion accommodating a negative pressure producing material and having an air vent and an ink supply port, and said ink accommodating portion having an ink injection opening and accommodating directly the ink to be supplied to the recording head, said ink cartridge further including a partition wall between said negative pressure producing material accommodating portion and said ink accommodating portion, said partition wall having a gap for supplying ink from said ink accommodating portion to said negative pressure producing material accommodating portion, said gap being formed between said partition wall and a bottom wall of said cartridge;

inserting an ink injector through said ink injection opening;

directly injecting the ink through said ink injector into said ink accommodating portion, while said ink supply port is open; and orienting the ink cartridge such that said gap is disposed at an upper location of said ink accommodating portion, wherein in said injecting step, the ink injector is in fluid communication with an ink container, the container containing the ink to be injected, and said ink injector penetrates said negative pressure producing material.

2. An ink filling method for filling an ink cartridge with ink to be supplied to a recording head for ejecting ink, the method comprising the steps of:

providing said ink cartridge having a negative pressure producing material accommodating portion and an ink accommodating portion, said negative pressure producing material accommodating portion accommodating a negative pressure producing material and having an air vent and an ink supply port, and said ink accommodating portion having an ink injection opening and accommodating directly the ink to be supplied to the recording head, said ink cartridge further including a partition wall between said negative pressure producing material accommodating portion and said ink accommodating portion, said partition wall having a gap for supplying ink from said ink accommodating portion to said negative pressure producing material accommodating portion, said gap being formed between said partition wall and a bottom wall of said cartridge;

inserting an ink injector through said ink injection opening;

directly injecting the ink through said ink injector into said ink accommodating portion, while said ink supply port is open; and orienting the ink cartridge such that said gap is disposed at an upper location of said ink accommodating portion, wherein in said injecting step, the ink injector is in fluid communication with an ink container, the container containing the ink to be injected, and said ink injector is provided with air discharging means for discharging air out of said ink accommodating portion.

3. An ink filling method for filling an ink cartridge with ink to be supplied to a recording head for ejecting ink, the method comprising the steps of:

providing said ink cartridge having a negative pressure producing material accommodating portion and an ink accommodating portion, said negative pressure producing material accommodating portion accommodating a negative pressure producing material and having an air vent and an ink supply port, and said ink accommodating portion having an ink injection opening and accommodating directly the ink to be supplied to the recording head, said ink cartridge further including a partition wall between said negative pressure producing material accommodating portion and said ink accommodating portion, said partition wall having a gap for supplying ink from said ink accommodating portion to said negative pressure producing material accommodating portion, said gap being formed between said partition wall and a bottom wall of said cartridge;

inserting an ink injector through said ink injection opening;

directly injecting the ink through said ink injector into said ink accommodating portion, while said ink supply port is open; and orienting the ink cartridge such that said gap is disposed at an upper location of said ink accommodating portion, wherein in said injecting step, the ink injector is in fluid communication with an ink container, the container containing the ink to be injected, and said ink injector has an opening for supplying the ink into said negative pressure producing material accommodating portion.

4. An ink filling apparatus for filling an ink cartridge with ink to be supplied to a recording head for ejecting ink, wherein said ink cartridge has a negative pressure producing material accommodating portion and an ink accommodating portion, said negative pressure producing material accommodating portion accommodating a negative pressure producing material and having an air vent and an ink supply port, and said ink accommodating portion having an ink injection opening and accommodating directly the ink to be supplied to the recording head, said ink cartridge further including a partition wall between said negative pressure producing material accommodating portion and said ink accommodating portion, said partition wall having a gap for supplying ink from said ink accommodating portion to said negative pressure producing material accommodating portion, said gap being formed between said partition wall and a bottom wall of said cartridge, said apparatus comprising:

an injection member for directly injecting the ink into said ink accommodating portion; and means for supplying the ink to said injection member;

wherein said injection member is injectable into the negative pressure producing material accommodating portion, and said injection member is long enough so that an end opening thereof is in said ink accommodating portion through said gap, when said injection member is inserted into said ink cartridge through said ink supply port, and said injection member is provided with a plurality of openings which open to said negative pressure producing material accommodating portion.

5. An ink filling apparatus for filling an ink cartridge with ink to be supplied to a recording head for ejecting ink, wherein said ink cartridge has a negative pressure producing material accommodating portion and an ink accommodating portion, said negative pressure producing material accommodating portion accommodating a negative pressure producing material and having an air vent and an ink supply port, and said ink accommodating portion having an ink injection opening and accommodating directly the ink to be supplied to the recording head, said ink cartridge further including a partition wall between said negative pressure producing material accommodating portion and said ink accommodating portion, said partition wall having a gap for supplying ink from said ink accommodating portion to said negative pressure producing material accommodating portion, said gap being formed between said partition wall and a bottom wall of said cartridge, said apparatus comprising:

an injection member for directly infecting the ink into said ink accommodating portion; and means for supplying the ink to said injection member;

wherein said injection member is injectable into the negative pressure producing material accommodating portion, and said injection member is long enough so that an end opening thereof is in said ink accommodating portion through said gap, when said injection member is inserted into said ink cartridge through said ink supply port, and said injection member is provided with air discharging means for discharging air from said ink accommodating portion.

* * * * *

UNITED STATES PATENT AND TRADEMARK OFFICE

CERTIFICATE OF CORRECTION

PATENT NO. : 5,790,157

DATED : August 4, 1998

INVENTOR(S) : Masahiko Higuma, et al.

It is certified that error appears in the above-identified patent and that said Letters Patent is hereby corrected as shown below:

ON THE COVER PAGE

Delete "Sadayuki Sugama, Tsukua" from the inventorship.

COLUMN 1

Line 28, change "use" to --using--.

COLUMN 3

Line 25, change "Nos." to --Nos. 198474/1992--.

COLUMN 4

Line 3, change "is" to --are--.

COLUMN 5

Line 9, change "to" to --to extend-- and delete "is";

Line 41, change "FIGS. 1A and 1B are" to --FIG. 1A is a--, and change "views" to --view--;

Line 42, after "invention.", insert a new paragraph, as follows: --FIG. 1B is a sectional view thereof.--; and Line 43, change "FIG. 2B" to --FIG. 2--.

UNITED STATES PATENT AND TRADEMARK OFFICE

CERTIFICATE OF CORRECTION

PATENT NO. : 5,790,157

DATED : August 4, 1998

INVENTOR(S) : Masahiko Higuma, et al.

It is certified that error appears in the above-identified patent and that said Letters Patent is hereby corrected as shown below:

COLUMN 6

Line 58, change "illustrates" to --illustrate--.

COLUMN 8

Line 19, change "Substantially" to --Substantially all--.

COLUMN 9

Line 48, change "then," to --Then,--.

COLUMN 11

Line 8, change "A s" to --As--; and

Line 67, change "and" to --and is--.

COLUMN 12

Line 51, change "not continues" to --not continuous--.

COLUMN 13

Line 33, delete "which"; and

Line 42, change "t o" to --to--.

UNITED STATES PATENT AND TRADEMARK OFFICE

CERTIFICATE OF CORRECTION

PATENT NO. : 5,790,157

DATED : August 4, 1998

INVENTOR(S) : Masahiko Higuma, et al.

It is certified that error appears in the above-identified patent and that said Letters Patent is hereby corrected as shown below:

COLUMN 15
Line 28, change "is" to --it is--; and
Line 60, change "needle" to --needles--.

COLUMN 16
Line 48, change "la" to --1a--; and
Line 53, delete "for example".

COLUMN 17
Line 8, change "extend" to --extends--;
Line 9, change the first occurrence of "of" to --to--;
Line 38, change "made" to --made for--; and
Line 43, change "is" to --are--.

COLUMN 18
Line 32, change "and but" to --and--.

COLUMN 19
Line 57, change "additives," to --additive,--; and
Line 58, change "by" to --by one--.

COLUMN 20
Line 13, change "ink" to --ink is--; and
Line 27, change "in the" to --in--.

UNITED STATES PATENT AND TRADEMARK OFFICE

CERTIFICATE OF CORRECTION

PATENT NO. : 5,790,157

DATED : August 4, 1998

INVENTOR(S) : Masahiko Higuma, et al. Page 4 of 4

It is certified that error appears in the above-identified patent and that said Letters Patent is hereby corrected as shown below:

COLUMN 22

Line 46, change "injection open-" to --supply port and through said gap, the ink injector being long enough to reach to said ink accommodating portion;--; and Line 47, delete "ing;".

COLUMN 23

Line 12, change "injection open-" to --supply port and through said gap, the ink injector being long enough to reach to said ink accommodating portion;--;

Line 13, delete "ing;";

Line 45, change "injection open-" to --supply port and through said gap, the ink injector being long enough to reach to said ink accommodating portion;--;

Line 46, delete "ing;"; and

Line 47, change "infecting" to --injecting--.

Signed and Sealed this

Tenth Day of October, 2000

*Attest:*

Q. TODD DICKINSON

*Attesting Officer*

*Director of Patents and Trademarks*